US008264514B2

(12) United States Patent
Nakasendo

(10) Patent No.: US 8,264,514 B2
(45) Date of Patent: Sep. 11, 2012

(54) RECORDING HEAD, LED HEAD, AND IMAGE FORMING APPARATUS

(75) Inventor: Takashi Nakasendo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1413 days.

(21) Appl. No.: 11/896,030

(22) Filed: Aug. 29, 2007

(65) Prior Publication Data

US 2008/0055670 A1 Mar. 6, 2008

(30) Foreign Application Priority Data

Sep. 4, 2006 (JP) ..... 2006-238793

(51) Int. Cl.
*B41J 2/435* (2006.01)
*B41J 2/47* (2006.01)

(52) U.S. Cl. ..... 347/237; 347/247

(58) Field of Classification Search ..... 347/130–132, 347/142, 144, 236–238, 246, 247, 128, 145
See application file for complete search history.

(56) References Cited

U.S. PATENT DOCUMENTS 5,973,709 A * 10/1999 Tanuma et al. ..... 347/131
6,137,518 A * 10/2000 Maeda ..... 347/131

FOREIGN PATENT DOCUMENTS

JP 06-297769 10/1994
JP 2005-342933 12/2005

* cited by examiner

*Primary Examiner* — Hai C Pham
(74) *Attorney, Agent, or Firm* — Rabin & Berdo, P.C.

(57) ABSTRACT

A recording head is supplied capable of generating a plurality of concentration dots on the same line without providing a complicated circuit. The recording head has a recording device array in which a plurality of recording devices are arranged, and comprises a first input terminal which inputs a first driving signal for deciding a first driving time; a second input terminal which inputs a second driving signal for deciding a second driving time; a selecting section which selects whether or not the driving signal of the first input terminal or the second input terminal is used for each of the recording devices; and a driving circuit which drives the corresponding recording device by the driving signal selected by the selecting section, wherein the plurality of recording devices of the recording device array are driven by selected signals on the basis of print data.

9 Claims, 24 Drawing Sheets

POSITIONS OF LEDS

POSITION INFORMATION

| | | | | | | | |
|---|---|---|---|---|---|---|---|
| 0 | 0 | 0 | 0 | 1 | 1 | 1 | 1 |

PRINT DATA

| | | | | | | | | |
|---|---|---|---|---|---|---|---|---|
| 1 | 1 | 1 | 1 | 1 | 1 | 1 | 1 | 1-LINE |
| 1 | 1 | 1 | 1 | 1 | 1 | 1 | 1 | 2-LINE |
| 1 | 1 | 1 | 1 | 1 | 1 | 1 | 1 | 3-LINE |
| 1 | 1 | 1 | 1 | 1 | 1 | 1 | 1 | 4-LINE |

AFTER RECEPTION OF THE 1ST LINE

| | | | | | | | | |
|---|---|---|---|---|---|---|---|---|
| 1 | 1 | 1 | 1 | 0 | 0 | 0 | 0 | 1-LINE |
| 0 | 0 | 0 | 0 | 0 | 0 | 0 | 0 | 2-LINE |
| 0 | 0 | 0 | 0 | 1 | 1 | 1 | 1 | 3-LINE |
| 0 | 0 | 0 | 0 | 0 | 0 | 0 | 0 | 4-LINE |
| 0 | 0 | 0 | 0 | 0 | 0 | 0 | 0 | 5-LINE |
| 0 | 0 | 0 | 0 | 0 | 0 | 0 | 0 | 6-LINE |

AFTER RECEPTION OF THE 2ND LINE

| | | | | | | | | |
|---|---|---|---|---|---|---|---|---|
| 1 | 1 | 1 | 1 | 0 | 0 | 0 | 0 | 1-LINE |
| 1 | 1 | 1 | 1 | 0 | 0 | 0 | 0 | 2-LINE |
| 0 | 0 | 0 | 0 | 1 | 1 | 1 | 1 | 3-LINE |
| 0 | 0 | 0 | 0 | 1 | 1 | 1 | 1 | 4-LINE |
| 0 | 0 | 0 | 0 | 0 | 0 | 0 | 0 | 5-LINE |
| 0 | 0 | 0 | 0 | 0 | 0 | 0 | 0 | 6-LINE |

AFTER RECEPTION OF THE 4TH LINE

| | | | | | | | | |
|---|---|---|---|---|---|---|---|---|
| 1 | 1 | 1 | 1 | 0 | 0 | 0 | 0 | 1-LINE |
| 1 | 1 | 1 | 1 | 0 | 0 | 0 | 0 | 2-LINE |
| 1 | 1 | 1 | 1 | 1 | 1 | 1 | 1 | 3-LINE |
| 1 | 1 | 1 | 1 | 1 | 1 | 1 | 1 | 4-LINE |
| 0 | 0 | 0 | 0 | 1 | 1 | 1 | 1 | 5-LINE |
| 0 | 0 | 0 | 0 | 1 | 1 | 1 | 1 | 6-LINE |

RECORDING HEAD, LED HEAD, AND IMAGE FORMING APPARATUS

BACKGROUND OF THE INVENTION

1. Field of the Invention

The invention relates to a recording head or an LED head using a plurality of recording devices and to an image forming apparatus using such a head.

2. Description of the Related Art

In a recording head and an LED head which are used in a conventional image forming apparatuses and in which a plurality of recording (light emitting) devices have been arranged, a plurality of recording (light emitting) devices arranged on a same scanning line are driven by a predetermined driving energy, respectively. To accomplish the above object, for example, in JP-A-1994(Heisei 6)-297769, a storing device for storing a driving time of each light emitting device and a counter for setting the driving time are provided for each light emitting device. The driving time is individually set every light emitting device on the basis of data set by the counter and a light emission amount of each light emitting device is adjusted so as to be uniformed.

In the above conventional recording head or LED head, since the storing device for storing the driving time of each light emitting device and the counter for setting the driving time are necessary every light emitting device, there is such a problem to be solved that the recording head or the LED head is complicated and expensive.

SUMMARY OF THE INVENTION

It is an object of the invention to provide a recording head or an LED head using a plurality of recording devices (i.e. a plurality of recording elements) and an image forming apparatus using such a head.

According to the present invention, there is provided a recording head having a recording device array in which a plurality of recording devices are arranged, comprising:

a first input terminal which inputs a first driving signal for deciding a first driving time;

a second input terminal which inputs a second driving signal for deciding a second driving time;

a selecting section which selects whether or not the driving signal of the first input terminal or the second input terminal is used for each of the recording devices; and a driving circuit which drives the corresponding recording device by the driving signal selected by the selecting section.

Further, according to the present invention, there is provided an LED head having a recording device array in which a plurality of recording devices are arranged, comprising:

a first input terminal which inputs a first driving signal for deciding a first driving time;

a second input terminal which inputs a second driving signal for deciding a second driving time;

a selecting section which selects whether or not the driving signal of the first input terminal or the second input terminal is used for each of the recording devices; and a driving circuit which drives the corresponding recording device by the driving signal selected by the selecting section.

Furthermore, according to the present invention, there is provided an image forming apparatus having a recording head including a recording device array in which a plurality of recording devices are arranged, wherein the recording head comprises:

a first input terminal which inputs a first driving signal for deciding a first driving time;

a second input terminal which inputs a second driving signal for deciding a second driving time;

a selecting section which selects whether or not the driving signal of the first input terminal or the second input terminal is used for each of the recording devices; and a driving circuit which drives the corresponding recording device by the driving signal selected by the selecting section.

In the recording head or the LED head according to the invention, the head has: the plurality of input terminals which can input the driving signals for mutually independently deciding the driving times; and the selecting section which is provided in correspondence to each of the plurality of recording devices and which selects one of the driving signals inputted from the plurality of input terminals, wherein the driving signal is selected on the basis of the print data and the recording device can be driven. Therefore, a plurality of concentration dots can be generated on the same line without providing a complicated circuit. Consequently, there is obtained such an effect that a situation in which the recording head or the LED head becomes complicated and expensive can be avoided.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A recording head, an LED head, and an image forming apparatus according to the invention are constructed as follows.

Embodiment 1

Explanation of (Construction)

Figure 1:
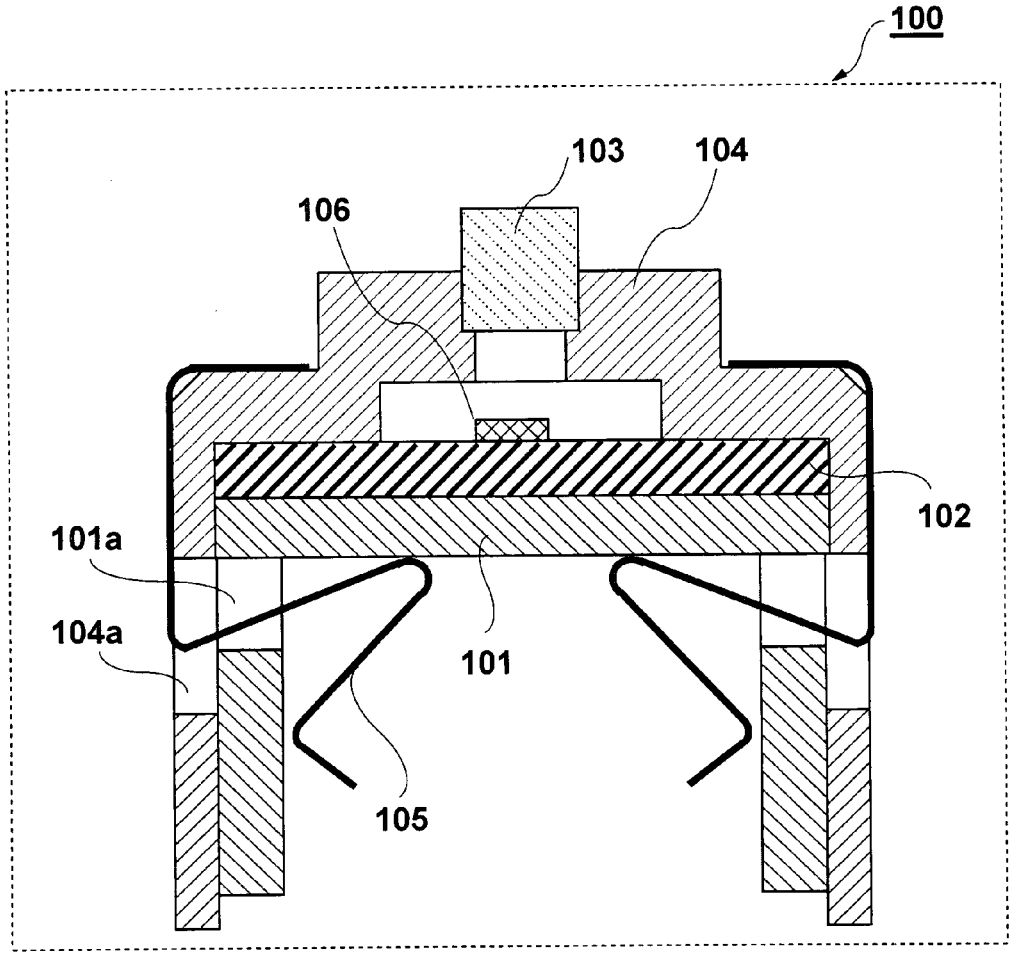
FIG. 1 is a cross sectional view of an LED head.

FIG. 1 is a cross sectional view of an LED head.

This diagram is the cross sectional view showing an LED head 100 serving as a recording head which is used in the embodiment 1.

Figure 2:
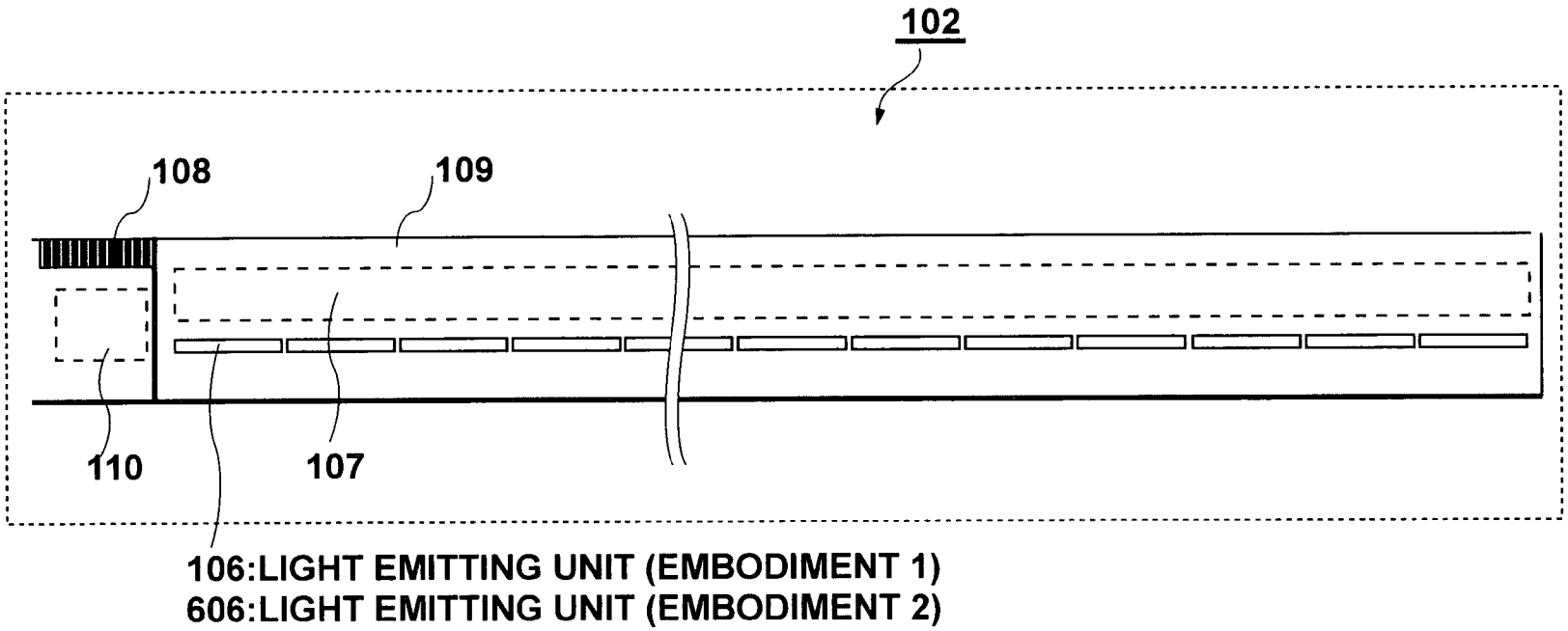
FIG. 2 is a plan view showing a layout of the LED head.

FIG. 2 is a plan view showing a layout of the LED head.

This diagram is the layout plan view showing a constructional example of a light emitting unit 106 shown in FIG. 1.

A construction of the LED head 100 as a recording head which is used in the embodiment 1 will now be described with reference to FIGS. 1 and 2.

As shown in the diagrams, an LED unit 102 has been mounted on a base member 101. A plurality of light emitting units 106 are arranged on an attaching board 109 in the longitudinal direction. In the embodiment, the 26 light emitting units 106 are arranged. Besides the light emitting units 106, electronic parts are arranged on the attaching board 109. Electronic part attaching areas 107 and 110 where wirings are formed and a connector 108 adapted to receive a control signal, a power source, and the like from the outside are also provided.

A rod lens array 103 serving as an optical device for collecting light emitted from the light emitting unit is arranged over the light emitting unit 106 (in the diagram). The rod lens array 103 is constructed by arranging a number of columnar optical lenses along the light emitting unit 106. The rod lens array 103 is held at a predetermined position by a lens holder 104 serving as an optical device holder. As illustrated in the diagram, the lens holder 104 is formed so as to cover the base member 101 and the LED unit 102. The base member 101, LED unit 102, and lens holder 104 are integratedly sandwiched by a damper 105 arranged through opening portions 101*a* and 104*a* formed in the base member 101 and the lens holder 104.

A schematic construction of a mechanism section of a printer (printing apparatus) in which the foregoing LED unit 102 described above is mounted will now be described.

Figure 3:
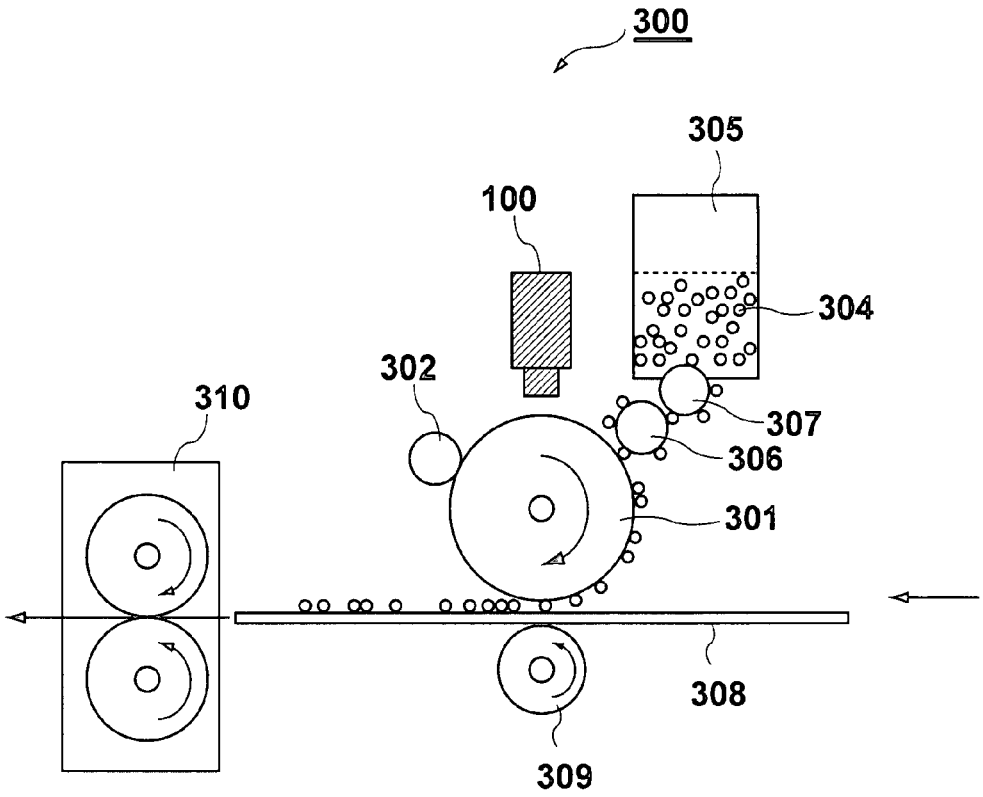
FIG. 3 is a cross sectional view illustrating a schematic construction of a printer.

FIG. 3 is a cross sectional view illustrating a schematic construction of the printer.

In the diagram, an electrostatic latent image is formed onto the surface of a photosensitive drum 301 by exposure. A charging roller 302, the LED head 100, a developing roller 306, and a transfer roller 309 are sequentially arranged around the photosensitive drum 301 from an upstream of a rotating direction (direction shown by an arrow in the diagram) of the photosensitive drum 301. The charging roller 302 charges the surface of the photosensitive drum 301 to negative charges. The LED head 100 exposes the surface of the photosensitive drum 301 which has been charged by the charging roller 302, thereby forming the electrostatic latent image. The LED head 100 is formed by arranging a plurality of LED devices in the main scanning direction.

Toner 304 is a developer. A toner cartridge 305 is filled with the toner 304. The developing roller 306 deposits the toner 304 onto the surface of the photosensitive drum 301 on which the electrostatic latent image has been formed, thereby developing a toner image. A supplying roller 307 supplies the toner 304 filled in the toner cartridge 305 to the developing roller 306. The transfer roller 309 transfers the toner image developed on the photosensitive drum 301 onto a print medium 308. A fixing apparatus 310 fixes the toner image transferred to the print medium 308 onto the surface of the print medium 308.

Subsequently, a control system of a printer (printing apparatus) 300 will be described.

Figure 4:
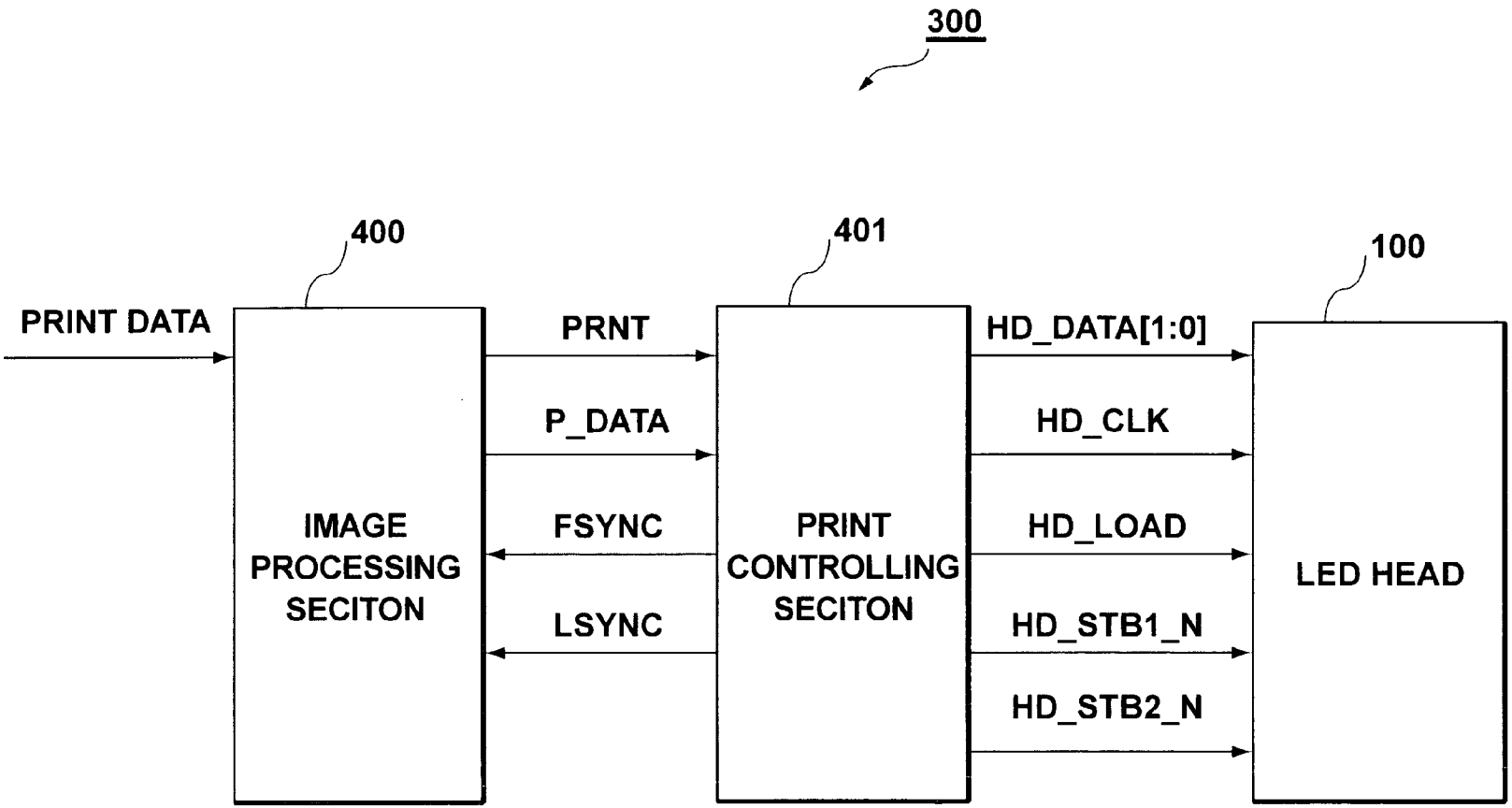
FIG. 4 is an explanatory diagram of a control system of the printer according to an embodiment 1.

FIG. 4 is an explanatory diagram of the control system of the printer according to the embodiment 1.

In the diagram, an image processing section 400 is a portion for receiving print data from an upper apparatus (not shown), developing the received print data into the print data on a line unit basis, and transmitting to a print controlling section 401. The print controlling section 401 is a portion for sending the received print data to the LED head 100 and controlling the operation of the LED head 100.

A print start instruction signal PRNT and print data P_DATA are transmitted from the image processing section 400 to the print controlling section 401. A transmission instruction signal FSYNC and a line sync signal LSYNC are transmitted from the print controlling section 401 to the image processing section 400. A print data signal HD_DATA [1:0], a clock signal HD_CLK, a latch signal HD_LOAD, and driving signals HD_STB1_N and HD_STB2_N are transmitted from the print controlling section 401 to the LED head 100.

Figure 5:
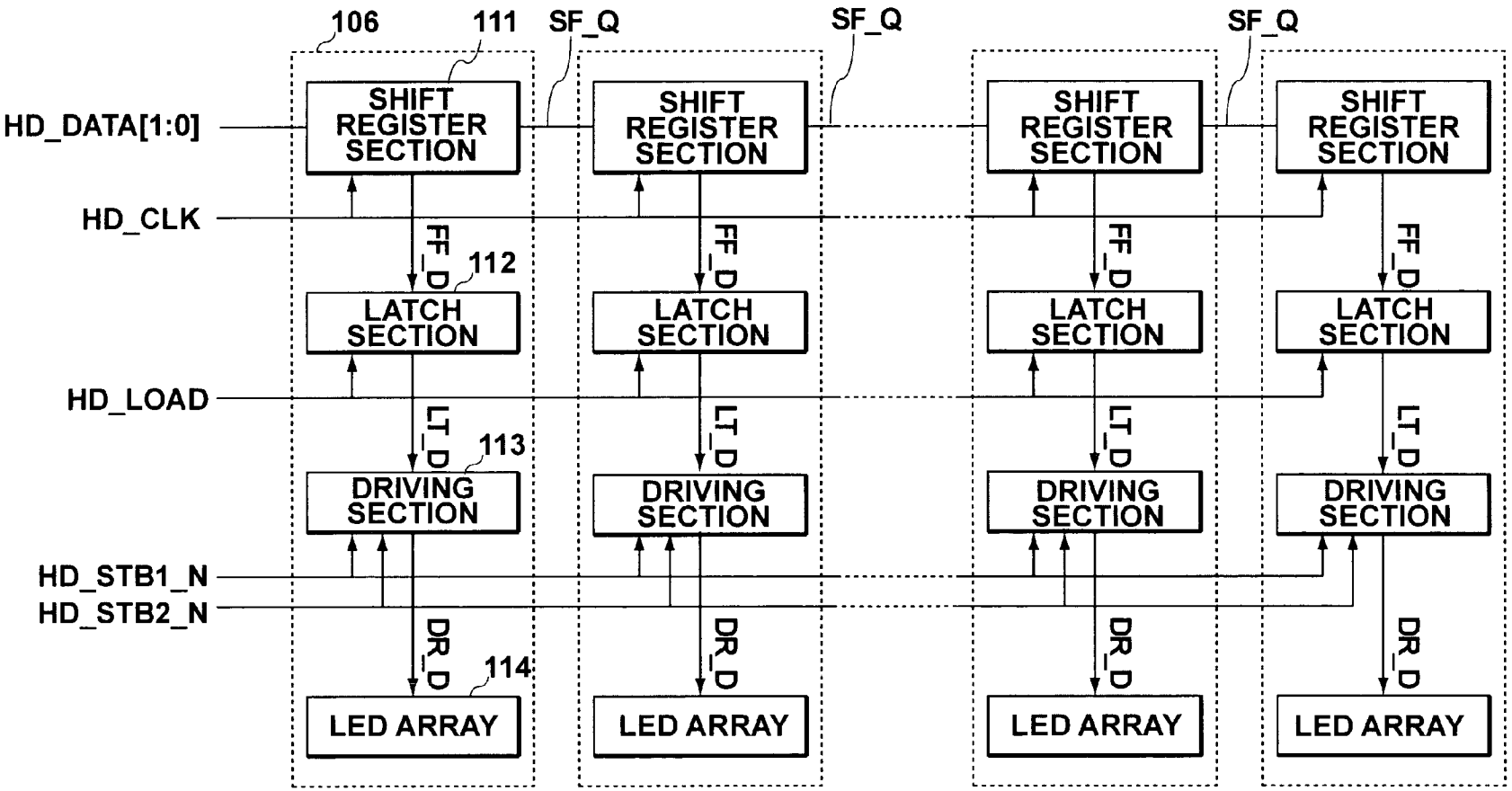
FIG. 5 is a block diagram of a light emitting unit in the embodiment 1.

FIG. 5 is a block diagram of the light emitting unit in the embodiment 1.

This diagram shows an internal construction of each light emitting unit 106 shown in FIG. 2 and a connection among the light emitting units 106.

In the diagram, the light emitting unit 106 has a shift register section 111, a latch section 112, a driving section 113, and an LED array 114. The LED array 114 in the embodiment is formed by arranging 192 light emitting diodes. The 26 light emitting units 106 each having the LED array 114 are arranged in the LED head 100 (FIG. 1), so that the total of 4992 (192×26) light emitting diodes are included in the LED head 100.

The shift register section 111 is a shift register of 192 stages constructed by 2-bit flip-flop circuits. The print data signal HD_DATA[1:0] and the clock signal HD_CLK are inputted to the shift register section 111. The print data and driving signal selection data of each light emitting diode are included in the print data signal HD_DATA[1:0]. A shift output signal SF_Q of the shift register section 111 is inputted to the shift register section in the next light emitting unit. A data output signal FF_D of the shift register section 111 and the latch signal HD_LOAD are inputted to the latch section 112. A data output signal LT_D from the latch section 112 and the driving signals HD_STB1_N and HD_STB2_N are inputted to the driving section 113. A data driving signal DR_D from the driving section 113 is inputted to the LED array 114. An internal construction of each section will be described in detail hereinbelow.

Figure 6:
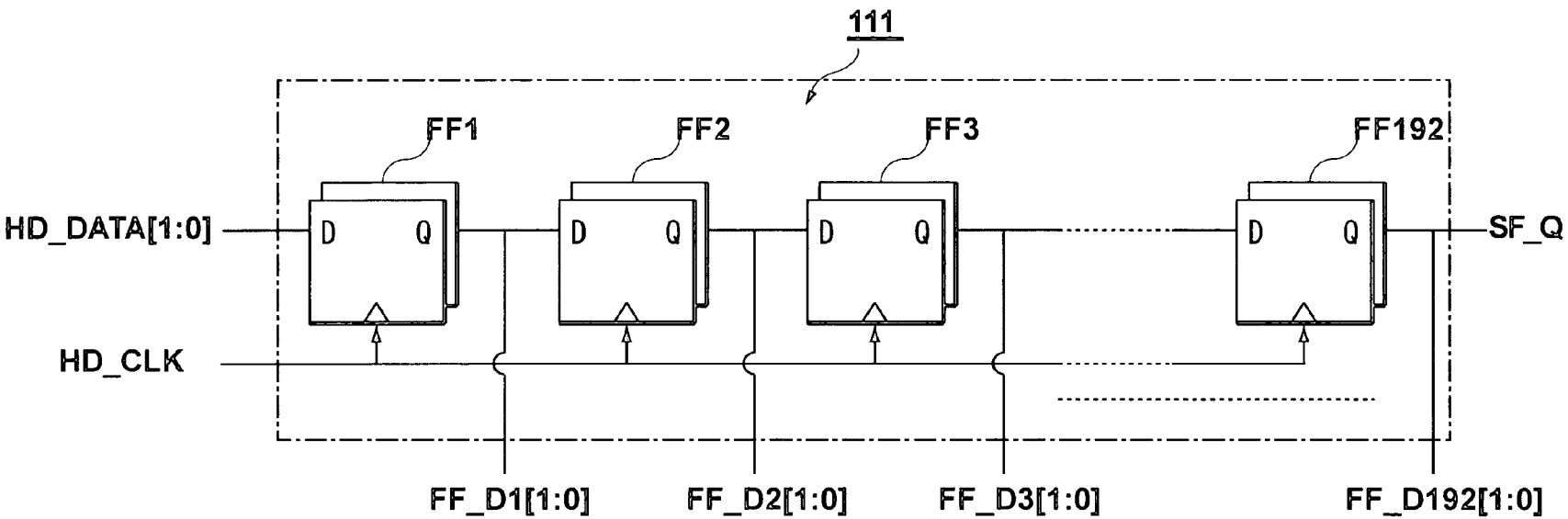
FIG. 6 is an internal constructional diagram of a shift register section in the embodiment 1.

FIG. 6 is an internal constructional diagram of the shift register section in the embodiment 1.

As shown in the diagram, the shift register section 111 is the shift register constructed by 192 flip-flops FF1 to FF192 of two bits. Data output signals FF_D1[1:0] to FF_D192[1:0] of two bits as outputs of the flip-flops FF1 to FF192 are signals showing in detail the data output signal FF_D in FIG. 5 and are inputted to the latch section 112. The shift output signal SF_Q as an output of the flip-flop FF192 of the final stage in the shift register section 111 is outputted to the subsequent shift register section in the next light emitting unit 106.

Figure 7:
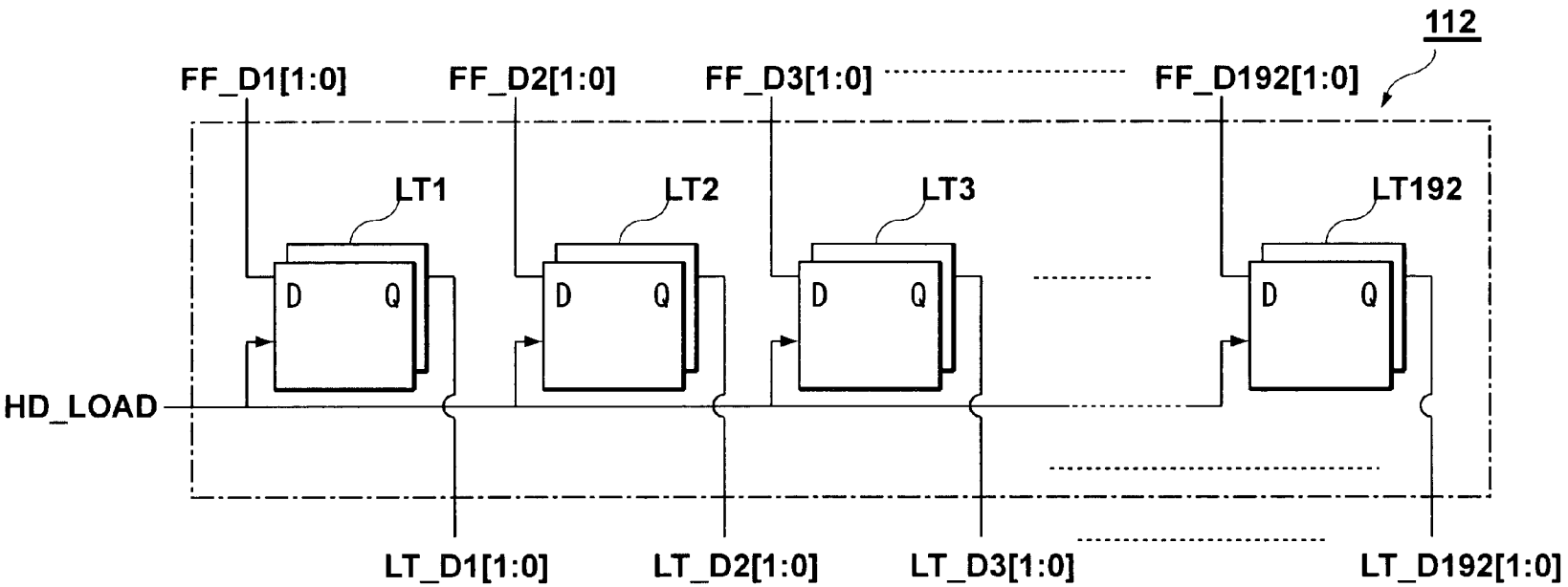
FIG. 7 is an internal constructional diagram of a latch section in the embodiment 1.

FIG. 7 is an internal constructional diagram of a latch section in the embodiment 1.

As shown in the diagram, the latch section 112 is constructed by 192 latch circuits LT1 to LT192 of two bits. The latch signal HD_LOAD and the 2-bit data output signals FF_D1[1:0] to FF_D192[1:0] as outputs of the flip-flops FF1 to FF192 of the shift register section 111 are inputted to the (2-bit) latch circuits LT1 to LT192, respectively. 2-bit data output signals LT_D1[1:0] to LT_D192[1:0] as outputs of the latch circuits LT1 to LT192 are signals showing in detail the data output signal LT_D of the latch section 112 shown in FIG. 5 and are inputted to the driving section 113.

Figure 8:
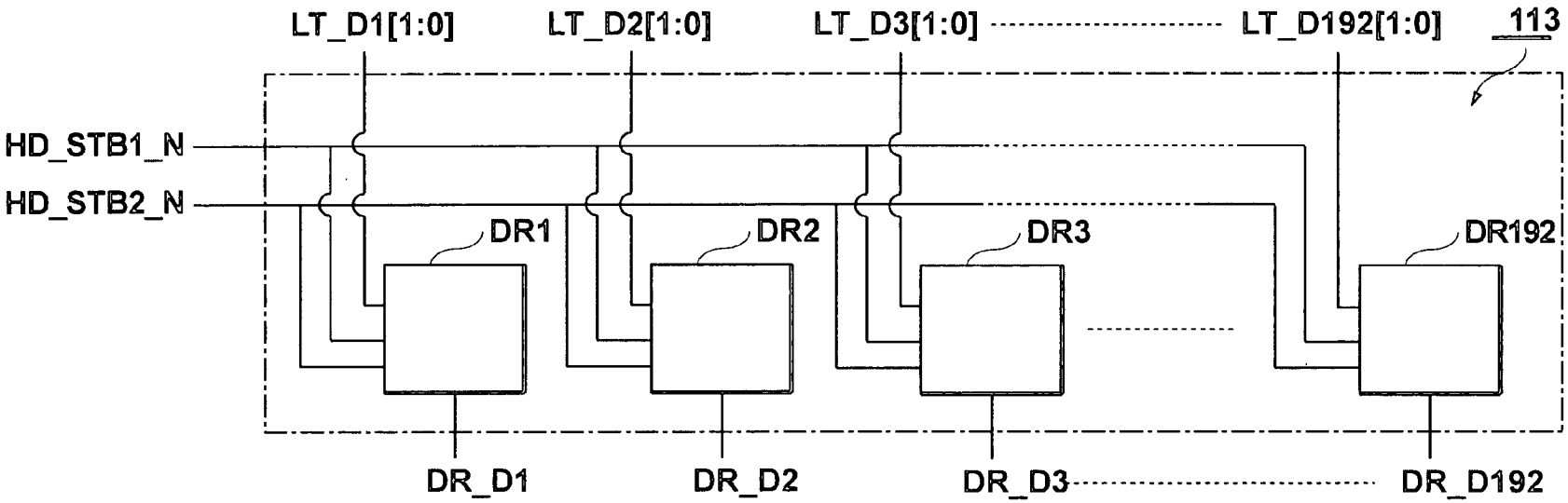
FIG. 8 is an internal constructional diagram of a driving section in the embodiment 1.

FIG. 8 is an internal constructional diagram of the driving section in the embodiment 1.

As shown in the diagram, the driving section 113 is constructed by 192 driving circuits DR1 to DR192. The driving signals HD_STB1_N and HD_STB2_N and the 2-bit data output signals LT_D1[1:0] to LT_D192[1:0] as outputs of the latch circuits LT1 to LT192 of the latch section 112 (FIG. 7) are inputted to the driving circuits DR1 to DR192, respectively. Data driving signals DR_D1 to DR_D192 as outputs of the driving circuits DR1 to DR192 are signals showing in detail the data driving signal DR_D of the driving section 113 shown in FIG. 5 and are inputted to the LED array 114.

Figure 9:
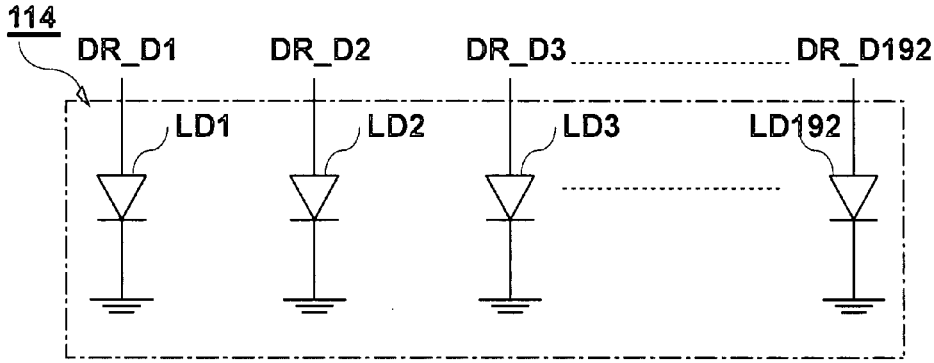
FIG. 9 is an internal constructional diagram of an LED array.

FIG. 9 is an internal constructional diagram of the LED array.

As shown in the diagram, the LED array 114 is constructed by 192 light emitting diodes LD1 to LD192. The data driving signals DR_D1 to DR_D192 as outputs of the driving circuits DR1 to DR192 of the driving section 113 (FIG. 8) are inputted to anodes of the light emitting diodes LD1 to LD192, respectively. Cathodes of the light emitting diodes LD1 to LD192 are connected to the ground.

Figure 10:
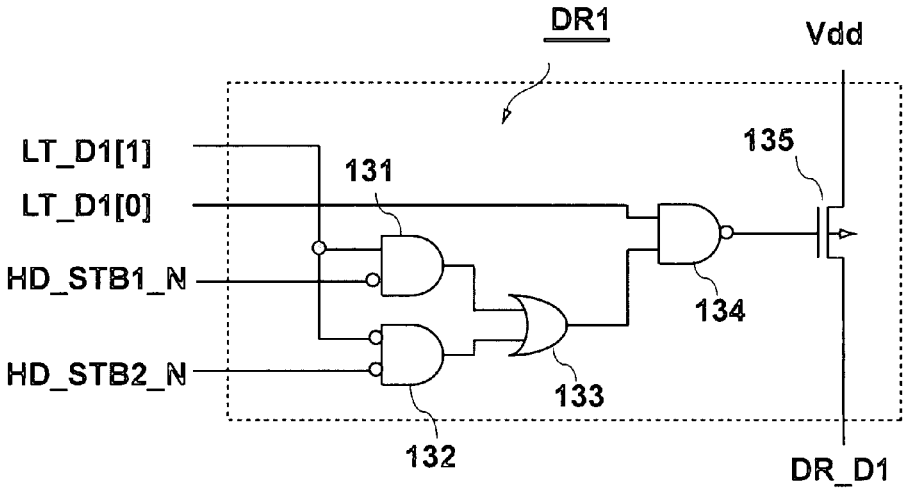
FIG. 10 is an internal constructional diagram of a driving circuit in the embodiment 1.

FIG. 10 is an internal constructional diagram of the driving circuit in the embodiment 1.

As shown in the diagram, the driving circuit DR1 includes AND circuits 131 and 132, an OR circuit 133, a NAND circuit 134, and a PMOS transistor 135. Upper one bit of the data output signal LT_D1[1:0] of the latch circuit LT1 (FIG. 7) and a negative logic signal of the driving signal HD_STB1_N are inputted to input terminals of the AND circuit 131. A negative logic signal of upper one bit of the data output signal LT_D1[1:0] of the latch circuit LT1 (FIG. 7) and a negative logic signal of the driving signal HD_STB2_N are inputted to input terminals of the AND circuit 132. Outputs of the AND circuits 131 and 132 are inputted to input terminals of the OR circuit 133. Lower one bit of the data output signal LT_D1[1:0] of the latch circuit LT1 (FIG. 7) and an output of the OR circuit 133 are inputted to input terminals of the NAND circuit 134. An output of the NAND circuit 134 is inputted to a gate of the PMOS transistor, a voltage Vdd is applied to a drain, and the light emitting diode LD1 is connected to a source (DR_D1), respectively.

Description of (Operation)

First, returning to FIG. 3, a printing process of the printer 300 to which the invention is applied will be described. First, the surface of the photosensitive drum 301 is uniformly charged to the negative polarity by the charging roller 302. Subsequently, the charged surface of the photosensitive drum 301 is selectively exposed by the LED head 100 and an electrostatic latent image is formed thereon. The toner 304 is deposited onto the surface of the photosensitive drum 301 formed with the electrostatic latent image and a toner image is developed by the developing roller 306. Subsequently, the toner is transferred onto the print medium 308 by the transfer roller 309. Then, the transferred toner image is fixed onto the print medium 308 by the fixing apparatus 310. The printing is executed while continuously repeating the above process.

The operation of the control system (FIG. 4) will now be described with reference to a time chart.

Figure 11:
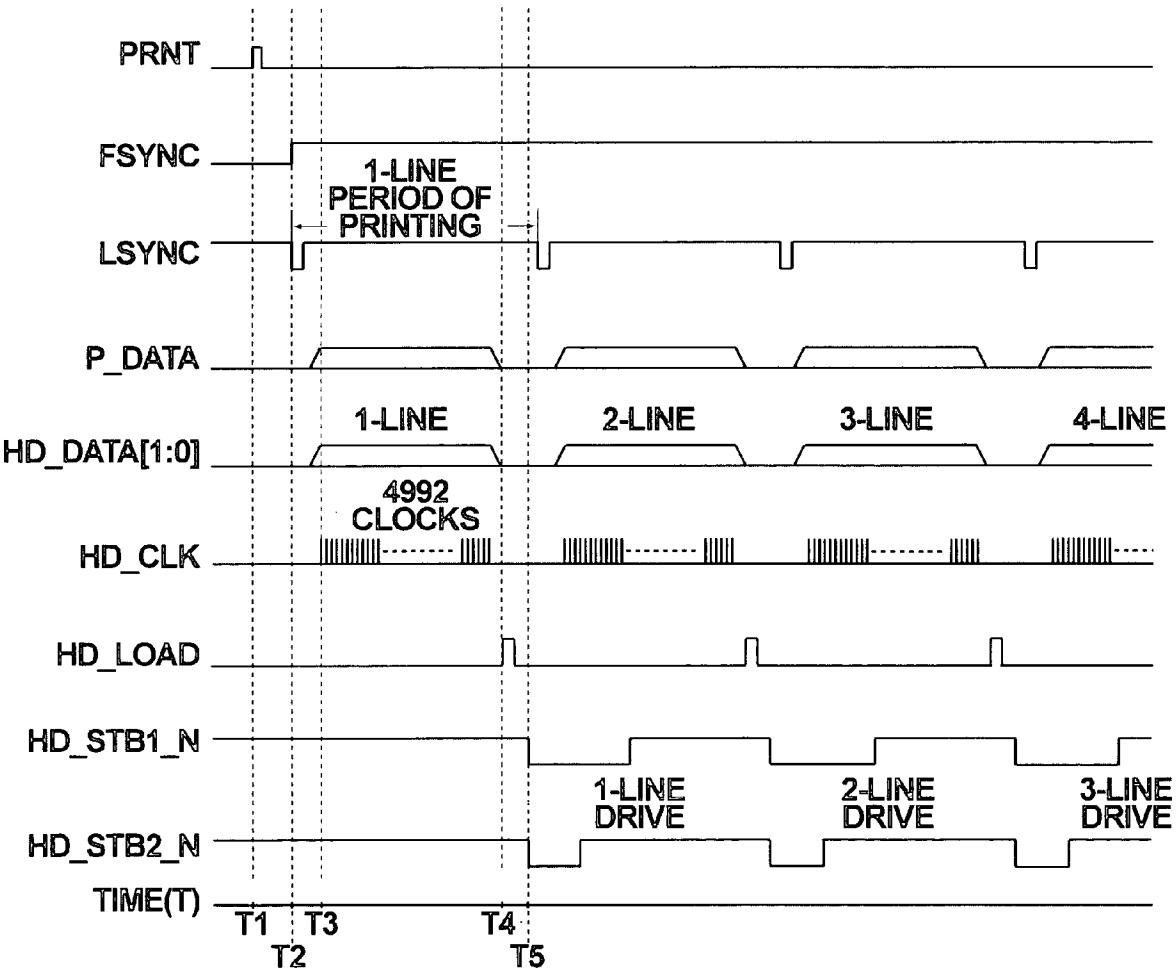
FIG. 11 is a time chart of the control system of the printer according to the embodiment 1.

FIG. 11 is a time chart of the control system of the printer in the embodiment 1.

This time chart shows the operations of the image processing section 400, print controlling section 401, and LED head 100. From the top in the diagram, signal waveforms of the following signals are sequentially shown: the print start instruction signal PRNT; the transmission instruction signal FSYNC; the line sync signal LSYNC; the print data P_DATA; the print data signal HD_DATA[1:0]; the clock signal HD_CLK; the latch signal HD_LOAD; and the driving signals HD_STB1_N and HD_STB2_N. Time (T) which is used in common for the above signals is shown at the bottom.

The operations of the image processing section 400, print controlling section 401, and LED head 100 will be described in detail hereinbelow in order of the time also with reference to FIGS. 4 and 5.

When the print data is received from an upper apparatus (not shown), the image processing section 400 (FIG. 4) develops the received print data on a line unit basis and starts to form the print data which is transmitted to the print controlling section 401.

Time T1:

When the print data is prepared, the image processing section 400 (FIG. 4) instructs the print start to the print controlling section 401 (FIG. 4) by the print start instruction signal PRNT.

Time T2:

When the print start instruction signal PRNT is received, the print controlling section 401 (FIG. 4) sends the transmission instruction signal FSYNC and the line sync signal LSYNC to the image processing section 400 (FIG. 4) so as to start the printing.

Time T3:

When the transmission instruction signal FSYNC and the line sync signal LSYNC are received, the image processing section 400 (FIG. 4) starts to transmit the print data of an amount corresponding to one line to the print controlling section 401 (FIG. 4) by using the print data P_DATA. Further, while the transmission instruction signal FSYNC is at the high (H) level, the image processing section 400 sends the print data of one line to the print controlling section 401 (FIG. 4) by using the print data P_DATA within an interval of a 1-line printing period of the line sync signal LSYNC.

The print data sent to the print controlling section 401 (FIG. 4) is sequentially transmitted to the LED head 100 (FIG. 4) by using the print data signal HD_DATA[1:0] synchronously with the clock signal HD_CLK.

The LED head 100 (FIG. 4) emits light on the basis of the data consisting of two bits per pixel. Therefore, the LED head 100 (FIG. 4) has a print data input of two bits. The LED head 100 (FIG. 4) in the embodiment has 4992 light emitting diodes. Therefore, the print controlling section 401 (FIG. 4) repetitively transmits the 2-bit data 4992 times by using the print data signal HD_DATA[1:0] synchronously with the clock signal HD_CLK, thereby sending the print data of one line.

The LED head 100 (FIG. 4) successively shifts and transfers the print data signal HD_DATA[1:0] of 2 bits to the shift register section 111 synchronously with the clock signal HD_CLK. The print data of one line is stored into the shift register of the LED head 100 (FIG. 4) by the clock signal HD_CLK of 4992 times.

Time T4:

The print controlling section 401 (FIG. 4) transmits the latch signal HD_LOAD to the LED head 100 (FIG. 4). When the latch signal HD_LOAD is received, the LED head 100 (FIG. 4) allows the latch section 112 (FIG. 5) to latch the data output signal FF_D (FIG. 5) stored in the shift register section 111 (FIG. 5).

Time T5:

The print controlling section 401 (FIG. 4) sends the driving signals HD_STB1_N and HD_STB2_N having different pulse widths to the LED head 100 (FIG. 4). When the driving signals HD_STB1_N and HD_STB2_N and the data output signal LT_D (FIG. 5) from the latch section 112 (FIG. 5) are received, the driving section 113 (FIG. 5) of the LED head 100 (FIG. 4) outputs the data driving signal DR_D (FIG. 5) in order to drive the LED array (FIG. 5).

The print controlling section 401 (FIG. 4) repeats such a series of operations on a line unit basis and controls the LED head 100 (FIG. 4).

A relationship between the driving signals HD_STB1_N and HD_STB2_N in the driving section 113 (FIG. 5) and the data driving signal DR_D (FIG. 5) will be described hereinbelow.

FIGS. 12A to 12D are time charts showing the operation of the driving section in the embodiment 1.

Those time charts show the operation of the input/output signals of the driving circuit DR1 (FIG. 10). The operation of the driving circuit DR1 will be described with reference to FIGS. 12A to 12D together with FIG. 10.

The data driving signal DR_D1 as an output of the driving circuit DR1 is connected to the anode of the light emitting diode LD1 (FIG. 9).

Figure 12A:
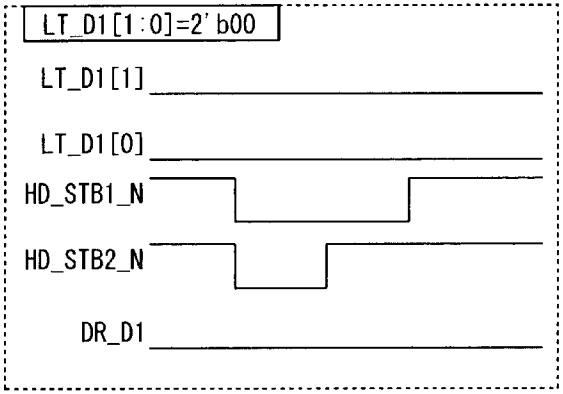
FIGS. 12A to 12D are time charts showing the operation of the driving section in the embodiment 1.

FIG. 12A is the time chart showing the operation of the data driving signal DR_D1 which is outputted from the driving circuit DR1 when the data output signal LT_D[1:0] is equal to 2'b00.

In this case, since a data output signal LT_D1[0] as one input of the NAND circuit 134 (FIG. 10) is at the low (L) level, the output of the NAND circuit 134 (FIG. 10) is at the H level. Therefore, the PMOS transistor 135 is turned off and the data driving signal DR_D1 which is outputted from the driving circuit DR1 is at the L level.

Figure 12B:
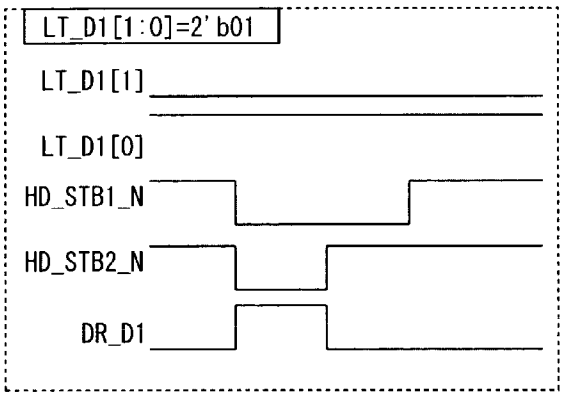

FIG. 12B is the time chart showing the operation of the data driving signal DR_D1 which is outputted from the driving circuit DR1 when the data output signal LT_D[1:0] is equal to 2'b01. In this case, since a data output signal LT_D1[1] as one input of the AND circuit 131 is at the L level, the output of the AND circuit 131 is at the L level. An inverse logic signal of the data output signal LT_D1[1] as one input of the AND circuit 132 is at the H level and the other input is an inverse logic signal of the driving signal HD_STB2_N. Therefore, the output of the AND circuit 132 is the inverse logic signal of the driving signal HD_STB2_N. Since the inputs of the OR circuit 133 are the L-level signal as an output of the AND circuit 131 and the inverse logic signal of the driving signal HD_STB2_N as an output of the AND circuit 132, the output of the OR circuit 133 is the inverse logic signal of the driving signal HD_STB2_N. The inputs of the NAND circuit 134 are the H-level data output signal LT_D1[0] and the inverse logic signal of the driving signal HD_STB2_N as an output of the OR circuit 133. Therefore, the output of the NAND circuit 134 is the same as the driving signal HD_STB2_N and the PMOS transistor 135 is turned on for a period of time during which the driving signal HD_STB2_N is at the L level. The data driving signal DR_D1 which is outputted from the driving circuit DR1 is set to the H level for a period of time during which the driving signal HD_STB2_N is at the L level.

Figure 12C:
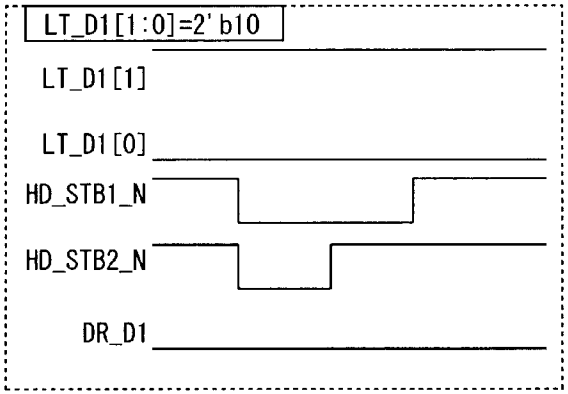

FIG. 12C is the time chart showing the operation of the data driving signal DR_D1 which is outputted from the driving circuit DR1 when the data output signal LT_D1[1:0] is equal to 2'b10.

In this case, since the data output signal LT_D1[0] as one input of the NAND circuit 134 is at the L level, the output of the NAND circuit 134 is at the H level. Therefore, the PMOS transistor 135 is turned off and the data driving signal DR_D1 which is outputted from the driving circuit DR1 is set to the L level.

Figure 12D:
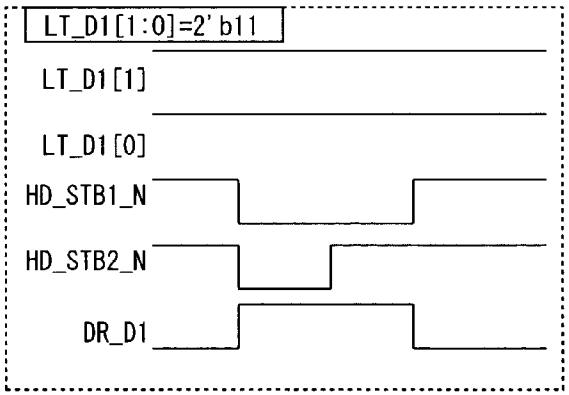

FIG. 12D is the time chart showing the operation of the data driving signal DR_D1 which is outputted from the driving circuit DR1 when the data output signal LT_D1[1:0] is equal to 2'b11.

In this case, since the data output signal LT_D1[1] as one input of the AND circuit 131 is at the H level and the other input is the inverse logic signal of the driving signal HD_STB1_N. Therefore, the output of the AND circuit 131 is the inverse logic signal of the driving signal HD_STB1_N. Since the inverse logic signal of the data output signal LT_D1[1] as one input of the AND circuit 132 is at the L level, the output of the AND circuit 132 is at the L level. Since the inputs of the OR circuit 133 are the inverse logic signal of the driving signal HD_STB1_N as an output of the AND circuit 131 and the L-level signal as an output of the AND circuit 132, the output of the OR circuit 133 is the inverse logic signal of the driving signal HD_STB1_N. The inputs of the NAND circuit 134 are the H-level data output signal LT_D1[0] and the inverse logic signal of the driving signal HD_STB1_N as an output of the OR circuit 133. Therefore, the output of the NAND circuit 134 is the same as the driving signal HD_STB1_N and the PMOS transistor 135 is turned on for a period of time during which the driving signal HD_STB1_N is at the L level. The data driving signal DR_D1 which is outputted from the driving circuit DR1 is set to the H level for a period of time during which the driving signal HD_STB1_N is at the L level.

As will be also understood from the operation of the driving circuit DR1, the upper one bit of the data output signal LT_D1[1:0] of the driving circuit DR1 is information showing the selection between the driving signals HD_STB1_N and HD_STB2_N and the lower one bit is information showing the selection about whether or not the light emitting diode is driven.

A pulse width of each of the driving signals HD_STB1_N and HD_STB2_N indicates a driving time of the light emitting diode. The driving signals HD_STB1_N and HD_STB2_N are the driving signals having the different pulse widths.

Figure 13:
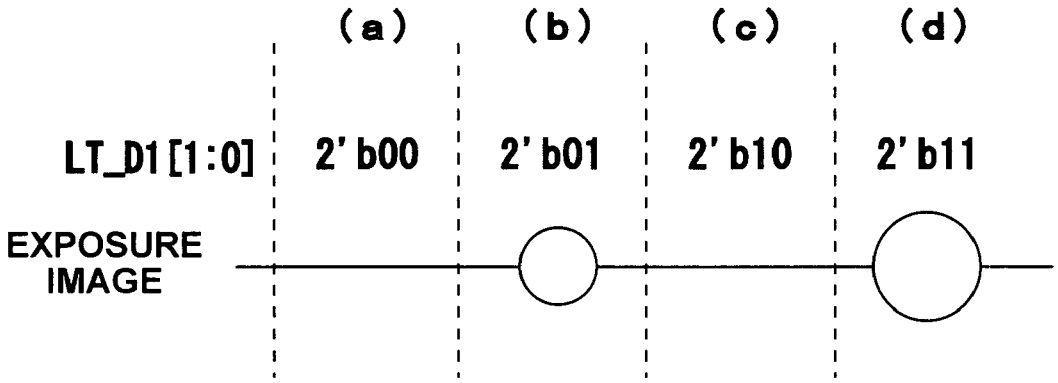
FIG. 13 is a diagram illustrating exposure images of a light emitting diode in the embodiment 1.

FIG. 13 is a diagram illustrating exposure images of the light emitting diode in the embodiment 1.

This diagram shows the exposure images of the light emitting diode corresponding to the data output signal LT_D1[1:0]. In (a) and (c), since the data output signal LT_D1[0] as information showing the selection about whether or not the light emitting diode is driven is at the L level, the drum surface is not exposed. In (b), since the data output signal LT_D1[1] as information showing the selection between the driving signals is at the L level, the driving signal HD_STB2_N is selected and the light emitting diode is driven for a period of time corresponding to the pulse width of the driving signal HD_STB2_N. In (d), since the data output signal LT_D1[1] as information showing the selection between the driving signals is at the H level, the driving signal HD_STB1_N is selected and the light emitting diode is driven for a period of time corresponding to the pulse width of the driving signal HD_STB1_N.

Although the embodiment has been described above on the assumption that the LED head is used as a form of the recording head, the invention can be also applied to a recording head using a resistive device, an organic EL device, or a liquid crystal shutter.

Explanation of (Effects)

As described in detail above, since the apparatus has the driving circuit which has a plurality of driving signal inputs and the print data inputs of a plurality of bits, selects the strobe signal on the basis of the print data, and drives the LEDs, such an effect that a plurality of concentration dots can be generated on the same line without providing a complicated circuit is obtained.

Embodiment 2

Explanation of (Construction)

Figure 14:
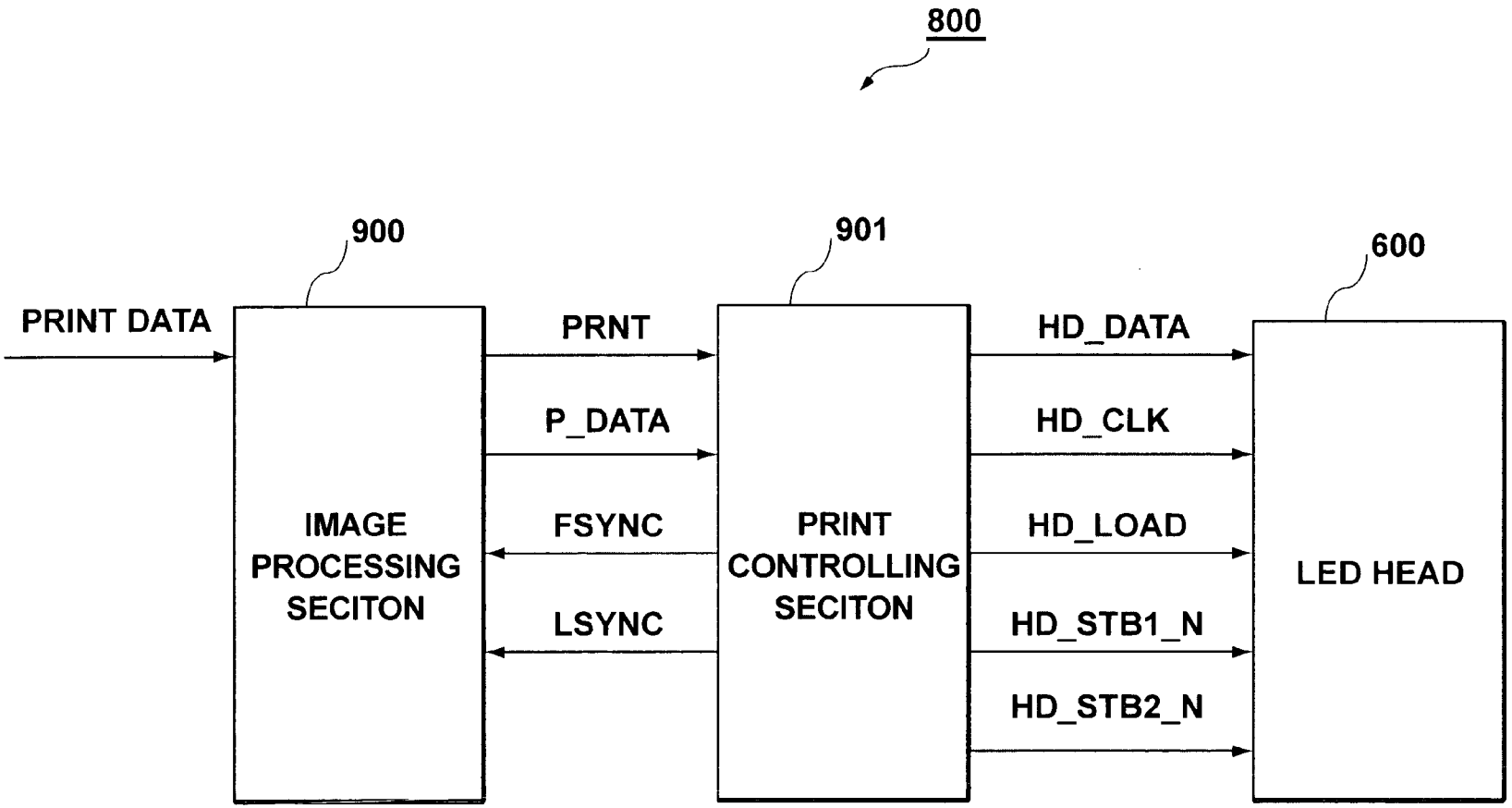
FIG. 14 is an explanatory diagram of a control system of a printer according to an embodiment 2.

FIG. 14 is an explanatory diagram of a control system of a printer (printing apparatus) 800 according to an embodiment 2.

An image processing section 900 is a portion for receiving the print data from the upper apparatus (not shown), developing the received print data into the print data on a line unit basis, and transmitting to a print controlling section 901. The print controlling section 901 is a portion for sending the received print data to an LED head 600 and controlling the operation of to the LED head 600.

The print start instruction signal PRNT and the print data P_DATA are transmitted from the image processing section 900 to the print controlling section 901. The transmission instruction signal FSYNC and the line sync signal LSYNC are transmitted from the print controlling section 901 to the image processing section 900. The print data signal HD_DATA, clock signal HD_CLK, latch signal HD_LOAD, and driving signals HD_STB1_N and HD_STB2_N are transmitted from the print controlling section 901 to the LED head 600.

Figure 15:
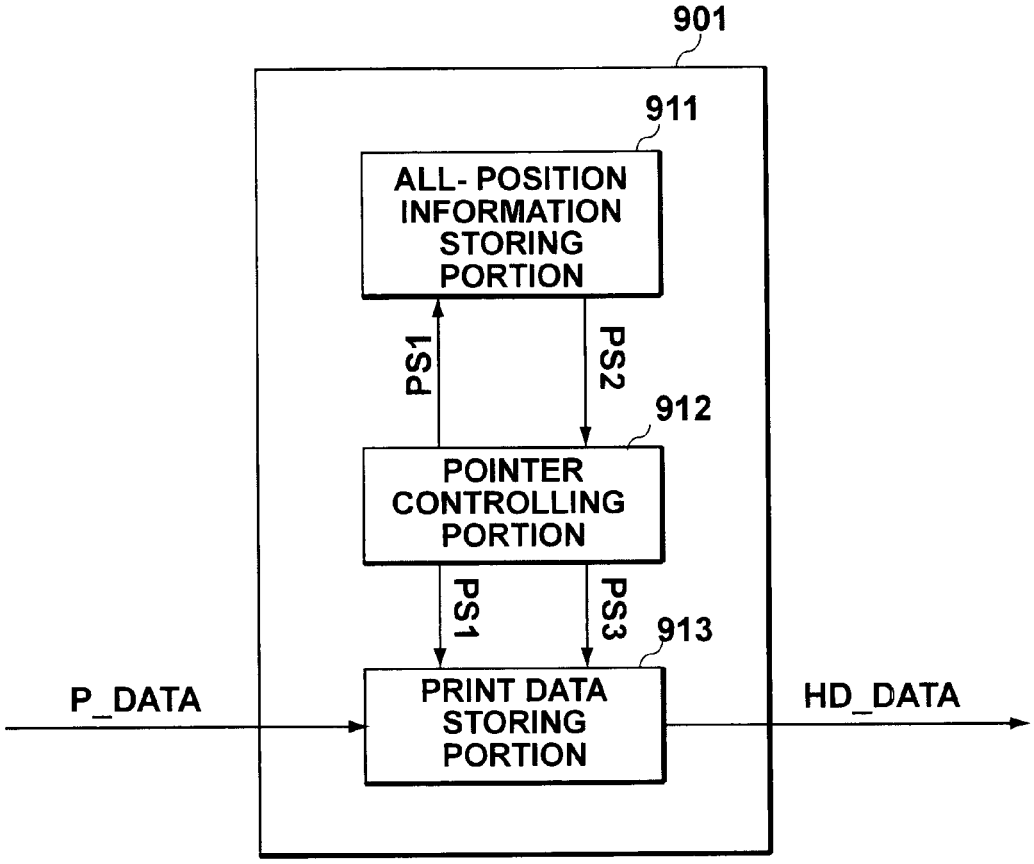
FIG. 15 is a block diagram of a construction of a print controlling section in the embodiment 2.

FIG. 15 is a block diagram of a construction of the print controlling section in the embodiment 2.

As shown in the diagram, the print controlling section 901 in the embodiment 2 has an all-position information storing portion 911, a pointer controlling portion 912, and a print data storing portion 913. The all-position information storing portion 911 is a memory for preliminarily storing position information of all of the light emitting diodes of the LED head 600 (FIG. 14). The pointer controlling portion 912 is a portion for controlling writing/reading points in the print data storing portion 913. The print data storing portion 913 is a buffer for temporarily storing the print data.

A position designation signal PS1 showing the order of the light emitting diode corresponding to the received print data P_DATA is transmitted from the pointer controlling portion 912 to the all-position information storing portion 911. A position information signal PS2 of the light emitting diode is transmitted from the all-position information storing portion 911 to the pointer controlling portion 912. The position information signal PS2 is the position information of the light emitting diode shown by the position designation signal PS1. The position designation signal PS1 showing the order of the light emitting diode corresponding to the received print data P_DATA and a line pointer PS3 obtained on the basis of the position information signal PS2 are transmitted from the pointer controlling portion 912 to the print data storing portion 913.

Figure 16:
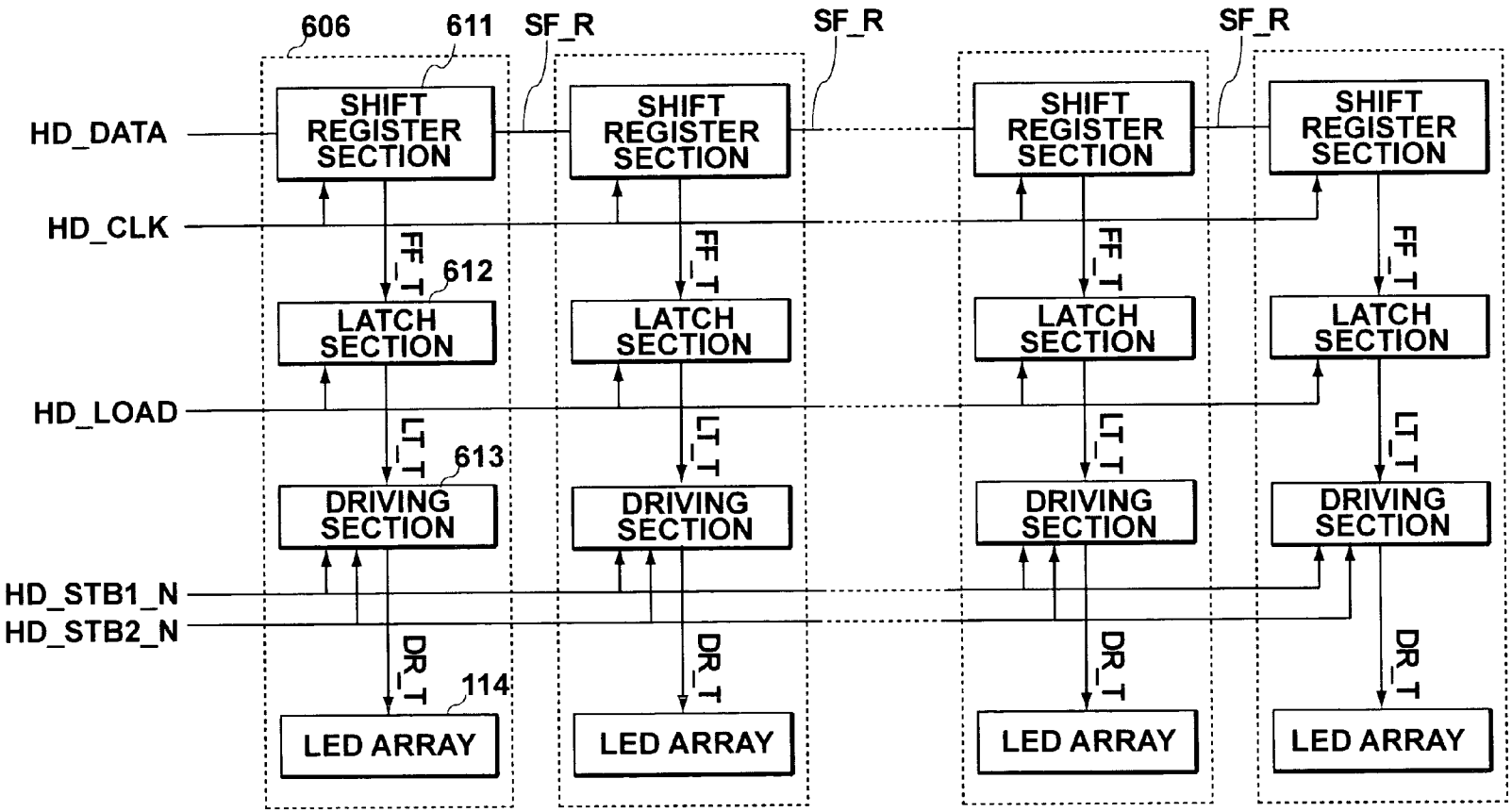
FIG. 16 is a block diagram of a light emitting unit in the embodiment 2.

FIG. 16 is a block diagram of the light emitting unit in the embodiment 2.

This diagram shows an internal construction of a light emitting unit 606 shown in FIG. 2 and a connection among the light emitting units 606. The light emitting unit 106 has a shift register section 611, a latch section 612, a driving section 613, and the LED array 114. The LED array 114 in the embodiment 2 is formed by arranging 192 light emitting diodes. The 26 light emitting units 606 each having the LED array 114 are arranged in the LED head 600 (FIG. 14), so that the total of 4992 (192×26) light emitting diodes are included in the LED head 600. The print data signal HD_DATA and the clock signal HD_CLK are inputted to the shift register section 611. A shift output signal SF_R of the shift register section 611 is inputted to the shift register section in the next light emitting unit.

A data output signal FF_T of the shift register section 611 and the latch signal HD_LOAD are inputted to the latch section 612. A data output signal LT_T from the latch section 612 and the driving signals HD_STB1_N and HD_STB2_N are inputted to the driving section 613. A data driving signal DR_T from the driving section 613 is inputted to the LED array 114. Each section will be described in detail hereinbelow.

Figure 17:
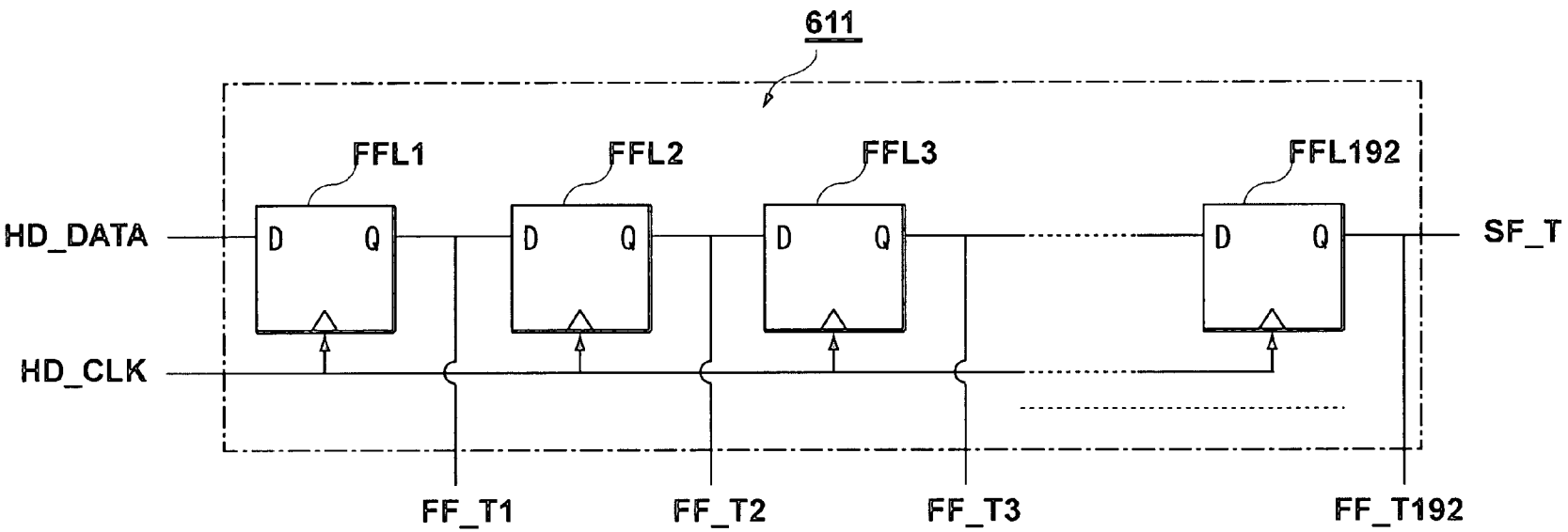
FIG. 17 is an internal constructional diagram of a shift register section in the embodiment 2.

FIG. 17 is an internal constructional diagram of the shift register section in the embodiment 2.

As shown in the diagram, the shift register section 611 is the shift register constructed by 192 flip-flops FFL1 to FFL192 of 1 bit. Data output signals FF_T1 to FF_T192 as outputs of the flip-flops FFL1 to FFL192 are signals showing in detail the data output signal FF_T in FIG. 16 and are inputted to the latch section 612. A shift output signal SF_T as an output of the flip-flop FFL192 of the final stage in the shift register section 611 is inputted to the shift register section in the next light emitting unit. Although the shift register section 111 (FIG. 6) in the embodiment 1 is constructed by the flip-flops of 2 bits, it should be noted that the shift register section 611 in the embodiment 2 is constructed by the flip-flops of 1 bit.

Figure 18:
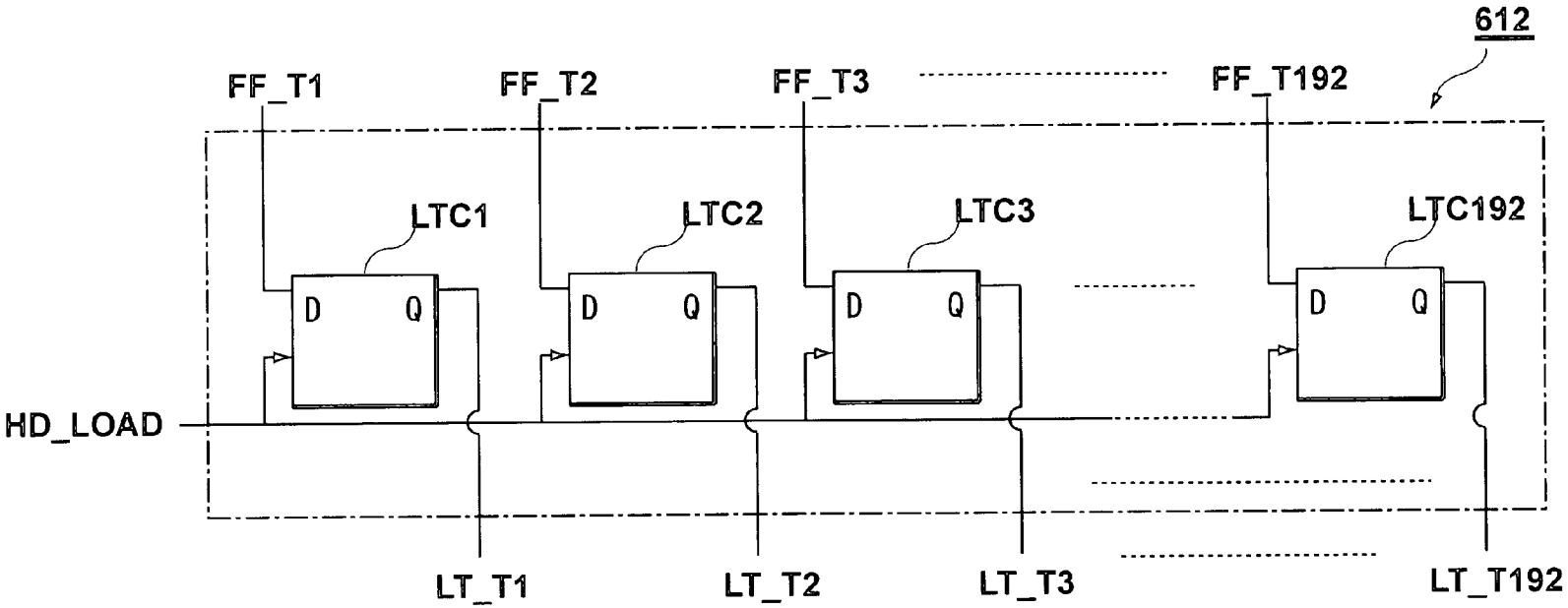
FIG. 18 is an internal constructional diagram of a latch section in the embodiment 2.

FIG. 18 is an internal constructional diagram of the latch section in the embodiment 2.

As shown in the diagram, the latch section 612 is constructed by 192 latch circuits LTC1 to LTC192 of 1 bit. The latch signal HD_LOAD and the data output signals FF_T1 to FF_T192 as outputs of the flip-flops FFL1 to FFL192 of the shift register section 611 are inputted to the latch circuits LTC1 to LTC192, respectively. Data output signals LT_T1 to LT_T192 as outputs of the latch circuits LTC1 to LTC192 are signals showing in detail the data output signal LT_T of the latch section 612 shown in FIG. 15 and are inputted to the driving section 613. Although the latch section 112 (FIG. 7) in the embodiment 1 is constructed by the latch circuits of 2 bits, it should be noted that the latch section 612 in the embodiment 2 is constructed by the latch circuits of 1 bit.

Figure 19:
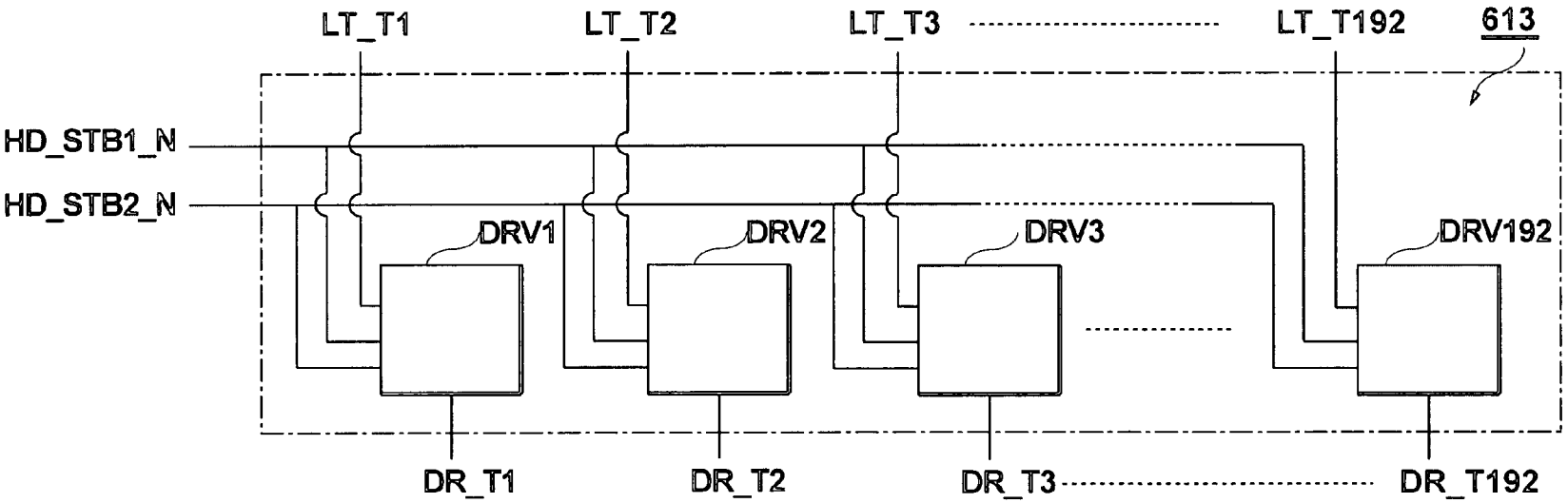
FIG. 19 is an internal constructional diagram of a driving section in the embodiment 2.

FIG. 19 is an internal constructional diagram of the driving section in the embodiment 2.

As shown in the diagram, the driving section 613 is constructed by 192 driving circuits DRV1 to DRV192. The driving signals HD_STB1_N and HD_STB2_N and the data output signals LT_T1 to LT_T192 as outputs of the latch circuits LTC1 to LTC192 of the latch section 612 are inputted to the driving circuits DRV1 to DRV192, respectively. Data output signals DR_T1 to DR_T192 as outputs of the driving circuits DRV1 to DRV192 are signals showing in detail the data driving signal DR_T of the driving section 613 shown in FIG. 16 and are inputted to the LED array 114. Although the driving section 113 (FIG. 8) in the embodiment 1 receives the 2-bit data output signals LT_D1[1:0] to LT_D192[1:0] from the latch section 112 (FIG. 7), it should be noted that the driving section 613 in the embodiment 2 receives the 1-bit data output signals LT_T1 to LT_T192 from the latch section 612 (FIG. 18).

Figure 20:
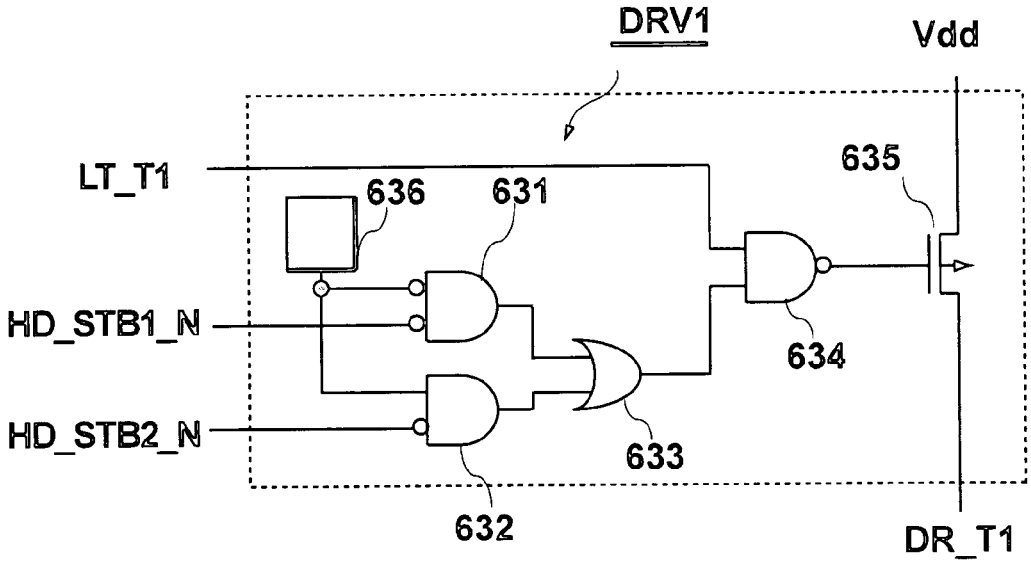
FIG. 20 is an internal constructional diagram of a driving circuit in the embodiment 2.

FIG. 20 is an internal constructional diagram of the driving circuit in the embodiment 2.

As shown in the diagram, the driving circuit DRV1 includes AND circuits 631 and 632, an OR circuit 633, a NAND circuit 634, a PMOS transistor 635, and a position information storing portion 636. A negative logic signal of an output of the position information storing portion 636 and a negative logic signal of the driving signal HD_STB1_N are connected to input terminals of the AND circuit 631. An output of the position information storing portion 636 and a negative logic signal of the driving signal HD_STB2_N are connected to input terminals of the AND circuit 632. Outputs of the AND circuits 631 and 632 are connected to input terminals of the OR circuit 633. An output of the NAND circuit 634 is connected to a gate of the PMOS transistor, the voltage Vdd is applied to a drain, and the light emitting diode LD1 is connected to a source (DR_T1), respectively.

The position information which is stored in the position information storing portion 636 is also stored in the print controlling section 901.

Description of (Operation)

The operation of the control system (FIG. 14) will now be described with reference to a time chart.

Figure 21:
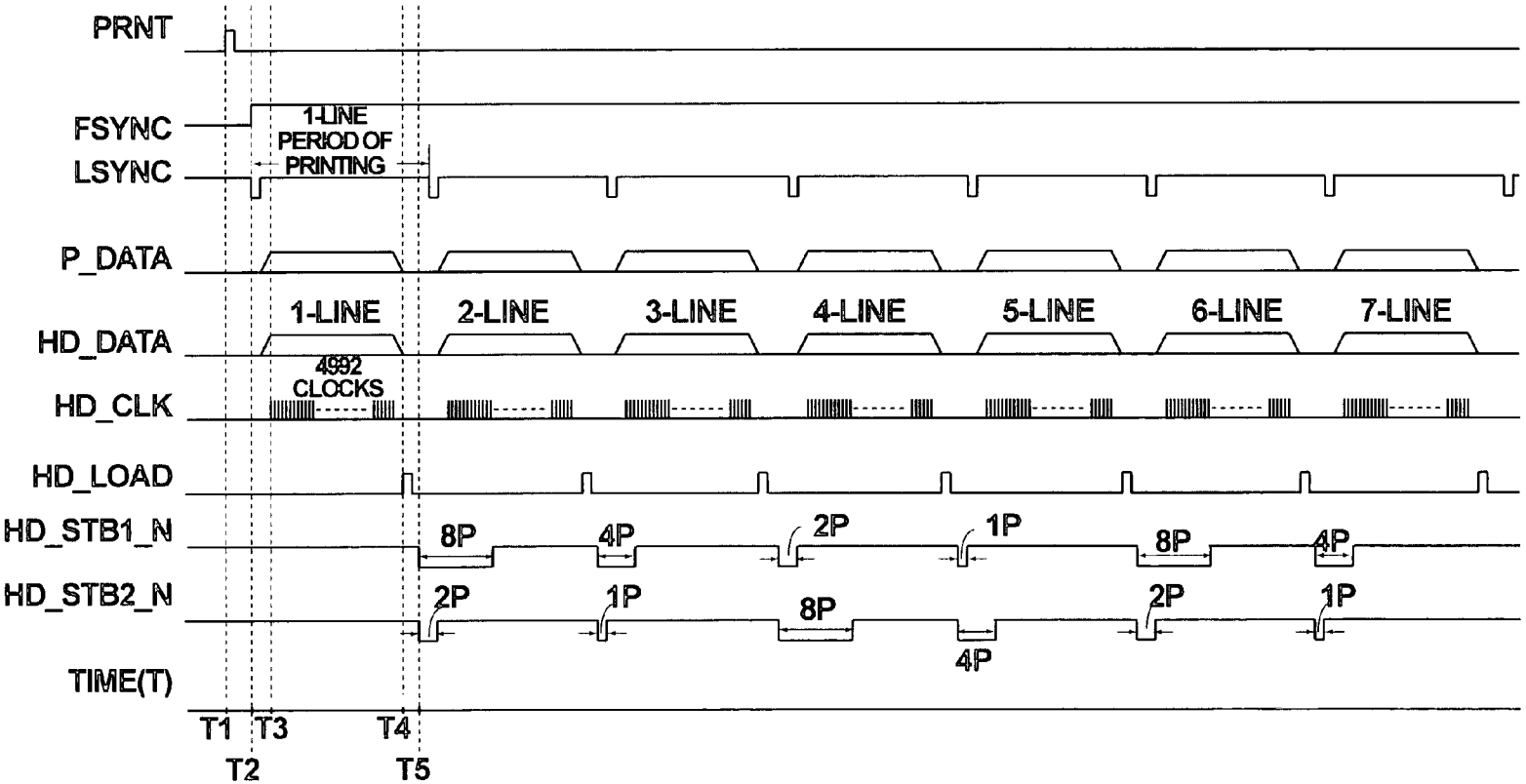
FIG. 21 is a time chart of the control system of the printer according to the embodiment 2.

FIG. 21 is a time chart of the control system of the printer according to the embodiment 2.

This time chart shows the operations of the image processing section 900, print controlling section 901, and LED head 600. From the top in the diagram, the signal waveforms of the following signals are sequentially shown: the print start instruction signal PRNT; the transmission instruction signal FSYNC; the line sync signal LSYNC; the print data P_DATA; the print data signal HD_DATA; the clock signal HD_CLK; the latch signal HD_LOAD; and the driving signals HD_STB1_N and HD_STB2_N. The time (T) which is used in common for the above signals is shown at the bottom.

The operations of the image processing section 900, print controlling section 901, and LED head 600 will be described in detail hereinbelow in order of the time with reference to FIG. 21 together with FIGS. 14 and 16.

When the print data is received from the upper apparatus (not shown), the image processing section 900 (FIG. 14) develops the received print data on a line unit basis and starts to form the print data which is transmitted to the print controlling section 901.

Time T1:

When the print data is prepared, the image processing section 900 (FIG. 14) instructs the print start to the print controlling section 901 by the print start instruction signal PRNT.

Time T2:

When the print start instruction signal PRNT is received, the print controlling section 901 (FIG. 14) sends the transmission instruction signal FSYNC and the line sync signal LSYNC to the image processing section 900 (FIG. 14) so as to start the printing.

Time T3:

When the transmission instruction signal FSYNC and the line sync signal LSYNC are received, the image processing section 900 (FIG. 14) starts to transmit the print data of an amount corresponding to one line to the print controlling section 901 (FIG. 14) by using the print data P_DATA. While the transmission instruction signal FSYNC is at the H level, the image processing section 900 (FIG. 14) sends the print data of one line to the print controlling section 901 (FIG. 14) by using the print data P_DATA within an interval of the line sync signal LSYNC. The print data sent to the print controlling section 901 is successively transmitted to the LED head 600 (FIG. 14) by using the print data P_DATA synchronously with the clock signal HD_CLK. Since the LED head 600 (FIG. 14) has 4992 light emitting diodes, the print controlling section 901 (FIG. 14) repetitively transmits the 1-bit data 4992 times by using the print data signal HD_DATA synchronously with the clock signals HD_CLK, thereby sending the print data of one line. The LED head 600 (FIG. 14) successively shifts and transfers the print data signal HD_DATA to the shift register section 611 (FIG. 14) synchronously with the clock signal HD_CLK. The print data of one line is stored into the shift register of the LED head 600 synchronously with the clock signals HD_CLK of 4992 times.

Time T4:

The print controlling section 901 (FIG. 14) transmits the latch signal HD_LOAD to the LED head 600 (FIG. 14). When the latch signal HD_LOAD is received, the LED head 600 (FIG. 14) allows the latch section 612 (FIG. 16) to latch the print data FF_T stored in the shift register section 611 (FIG. 14).

Time T5:

The print controlling section 901 (FIG. 14) sends the driving signals HD_STB1_N and HD_STB2_N having the different pulse widths to the LED head 600 (FIG. 14). When the driving signals HD_STB1_N and HD_STB2_N and the data output signal LT_T from the latch section 612 are received, the driving section 613 (FIG. 16) of the LED head 600 (FIG. 14) outputs the data driving signal DR_T in order to drive the LED array. The print controlling section 901 (FIG. 14) repeats such a series of operations on a line unit basis and controls the LED head 600 (FIG. 14). The print controlling section 901 (FIG. 14) sequentially and repetitively outputs the driving signals HD_STB1_N having the pulse widths of 2P, 1P, 8P, and 4P on a line unit basis (P is an arbitrary unit).

Subsequently, the operation of the driving circuit DRV1 will be described with reference to FIG. 20. The position information of 1 bit has previously been stored in the position information storing portion 636. The position information storing portion 636 outputs the stored position information.

First, the case where the position information stored in the position information storing portion 636 is at the L level will be described. Since one input of the AND circuit 631 is the H-level inverse logic signal of the position information and the other input is the inverse logic signal of the driving signal HD_STB1_N, the output of the AND circuit 631 is the inverse logic signal of the driving signal HD_STB1_N. Since the position information as one input of the AND circuit 632 is at the L level, the output of the AND circuit 632 is at the L level. Since the inputs of the OR circuit 633 are the inverse logic signal of the driving signal HD_STB1_N as an output of the AND circuit 631 and the L-level signal as an output of the AND circuit 632, the output of the OR circuit 633 is the inverse logic signal of the driving signal HD_STB1_N.

Since inputs of the NAND circuit 634 are the data output signal LT_T1 and the inverse logic signal of the driving signal HD_STB1_N as an output of the OR circuit 633, only when the data output signal LT_T1 is at the H level, the output of the NAND circuit 634 is the same as the driving signal HD_STB1_N and turns on the PMOS transistor 635 for a period of time during which the driving signal HD_STB1_N is at the L level. The data output signal DR_T1 which is outputted from the driving circuit DRV1 is set to the H level for a period of time during which the driving signal HD_STB1_N is at the L level.

Subsequently, the case where the position information stored in the position information storing portion 636 is at the H level will be described. Since the position information as one input of the AND circuit 631 is the L-level inverse logic signal and the other input is the inverse logic signal of the driving signal HD_STB1_N, the output of the AND circuit 631 is at the L level. Since the position information as one input of the AND circuit 632 is the H level and the other input is the inverse logic signal of the driving signal HD_STB2_N, the output of the AND circuit 632 is the inverse logic signal of the driving signal HD_STB2_N. Since the inputs of the OR circuit 633 are the L-level signal as an output of the AND circuit 631 and the inverse logic signal of the driving signal HD_STB2_N as an output of the AND circuit 632, the output of the OR circuit 633 is the inverse logic signal of the driving signal HD_STB2_N. Since the inputs of the NAND circuit 634 are the data output signal LT_T1 and the inverse logic signal of the driving signal HD_STB2_N as an output of the OR circuit 633, only when the data output signal LT_T1 is at the H level, the output of the NAND circuit 634 is the same as the driving signal HD_STB2_N and turns on the PMOS transistor 635 for a period of time during which the driving signal HD_STB2_N is at the L level. The data output signal DR_T1 which is outputted from the driving circuit DRV1 is set to the H level for a period of time during which the driving signal HD_STB2_N is at the L level.

Subsequently, the operation of the LED head 600 (FIG. 14) for expressing the gradation by a plurality of dots arranged on n lines at the same main scanning position by using n lines will be described. It is now assumed that n is equal to 4.

Figure 22:
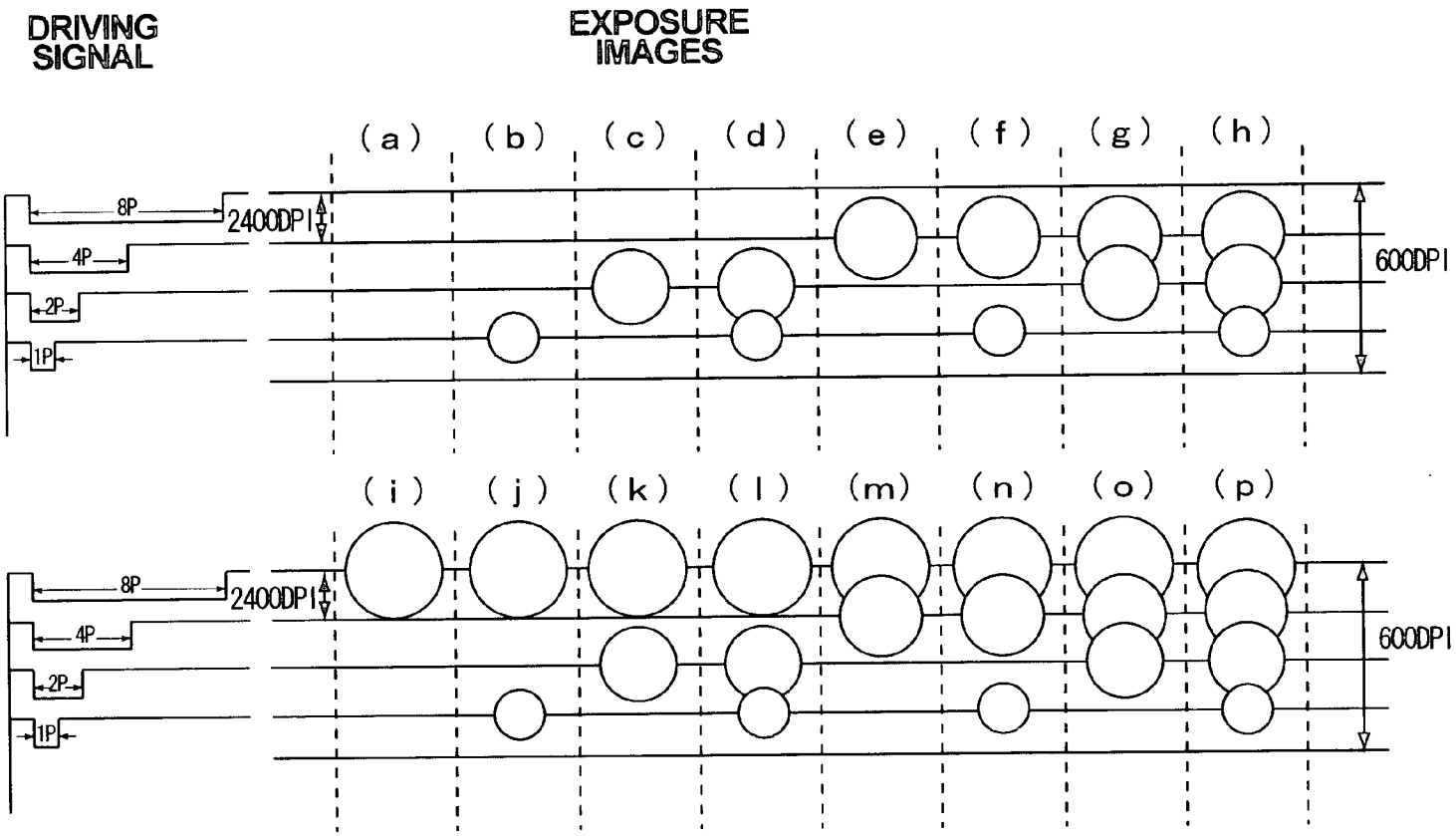
FIG. 22 is a diagram (part 1) illustrating exposure images of a light emitting diode in the embodiment 2.

FIG. 22 is a diagram (part 1) illustrating exposure images of the light emitting diode in the embodiment 2.

This diagram schematically shows the driving signals and the exposure images in the case of expressing the gradation by four lines of different driving times. An explanation will be made also with reference to FIG. 20.

It is now assumed that the gradation of 600 dpi in the vertical direction is expressed by four lines arranged at an interval of 2400 dpi in the vertical direction and that the L-level signal has been stored in the position information storing portion 636 of the driving circuit DRV1. Therefore, the driving signal HD_STB1_N is always selected. In the diagram, (a) shows the exposure image which is formed in the case where the data output signal LT_T1 is equal to (0, 0, 0, 0) in order from the top line; (b) shows the exposure image in the case of (0, 0, 0, 1); and (c) shows the exposure image in the case of (0, 0, 1, 0).

(d) shows the exposure image in the case of (0, 0, 1, 1); (e) shows the exposure image in the case of (0, 1, 0, 0); (f) shows the exposure image in the case of (0, 1, 0, 1); (g) shows the exposure image in the case of (0, 1, 1, 0); (h) shows the exposure image in the case of (0, 1, 1, 1); (i) shows the exposure image in the case of (1, 0, 0, 0); (j) shows the exposure image in the case of (1, 0, 0, 1); (k) shows the exposure image in the case of (1, 0, 1, 0); (l) shows the exposure image in the case of (1, 0, 1, 1); (m) shows the exposure image in the case of (1, 1, 0, 0); (n) shows the exposure image in the case of (1, 1, 0, 1); (o) shows the exposure image in the case of (1, 1, 1, 0); and (p) shows the exposure image in the case of (1, 1, 1, 1). In this manner, the different kinds of gradations of (a) to (p) can be expressed by the four lines of different driving times.

Figure 23B:
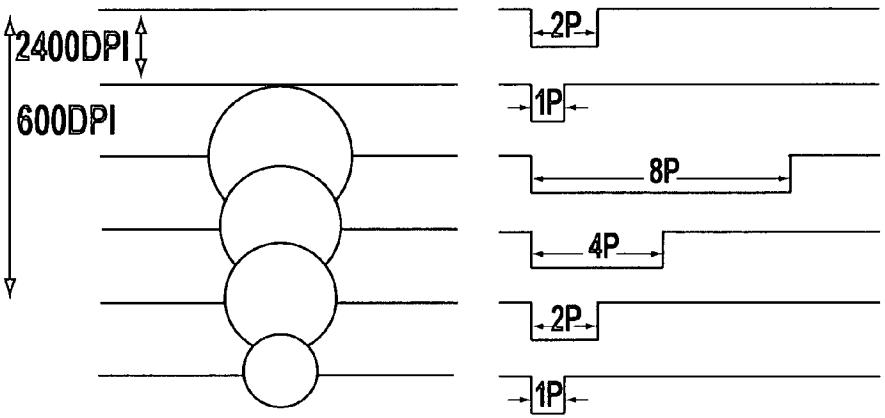
FIGS. 23A and 23B are diagrams (part 2) illustrating exposure images of the light emitting diode in the embodiment 2.
Figure 23A:
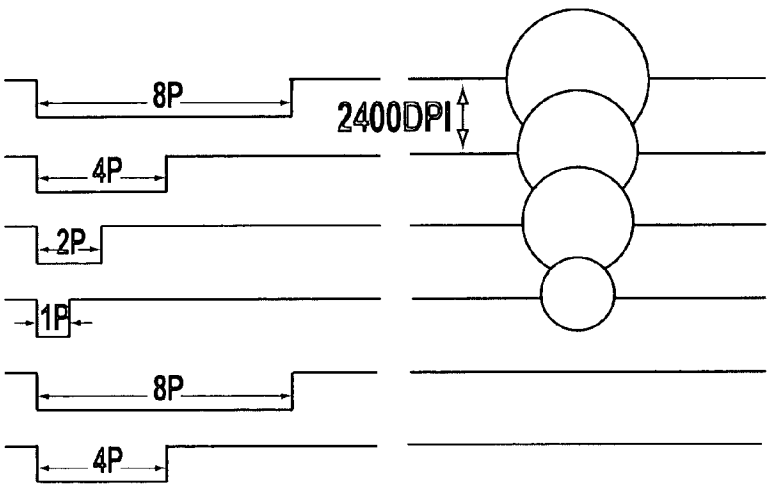

FIGS. 23A and 23B are diagrams (part 2) illustrating exposure images of the light emitting diode in the embodiment 2.

FIG. 23A shows the exposure image which is formed in the case where the position information stored in the position information storing portion 636 of the driving circuit DRV1 is at the L level and in the case of the data in which the data output signal LT_T1 is equal to (1, 1, 1, 1, 0, 0) in order from the top line. FIG. 23B shows the exposure image which is formed in the case where the position information stored in the position information storing portion 636 of the driving circuit DRV1 is at the H level and in the case of the data in which the data output signal LT_T1 is equal to (0, 0, 1, 1, 1, 1) in order from the top line (that is, the data which is deviated downward by two lines from the data of FIG. 23A). According to the value stored in the position information storing portion 636, the driving signal HD_STB1_N (FIG. 20) is selected in the case of FIG. 23A and the driving signal HD_STB2_N (FIG. 20) is selected in the case of FIG. 23B. It will be understood that the exposure image in FIG. 23B is shifted downward by 1200 dpi from that in FIG. 23A.

FIGS. 24A to 24F are diagrams illustrating images of a deviation of attaching positions of the light emitting diodes in the embodiment 2.

Figures 24A, 24B, 24C, 24D, 24E, 24F:
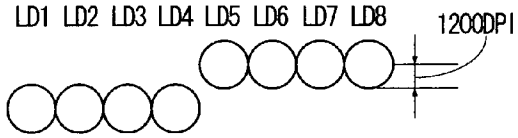
FIGS. 24A to 24F are diagrams illustrating images of a deviation of attaching positions of the light emitting diodes in the embodiment 2.

FIG. 24A is the image diagram showing the attaching positions of the light emitting diodes. FIG. 24B is the diagram showing the position information corresponding to FIG. 24A. FIG. 24C is the diagram showing an example of the print data which is transmitted from the image processing section 900 to the print controlling section 901. FIG. 24D is the diagram showing the contents in the print data storing portion 913 after the print data of the first line was transmitted from the image processing section 900 to the print controlling section 901.

FIG. 24E is the diagram showing the contents in the print data storing portion 913 after the print data of the second line was transmitted from the image processing section 900 to the print controlling section 901. FIG. 24F is the diagram showing the contents in the print data storing portion 913 after the print data of the fourth line was transmitted from the image processing section 900 to the print controlling section 901.

The case where the attaching positions of the light emitting diodes are deviated will now be described with reference to FIGS. 24A to 24F together with FIG. 15. For convenience of explanation, an explanation will be made here on the assumption that the only eight light emitting diodes LD1 to LD8 are arranged. As shown in FIG. 24A, it is now assumed that the four light emitting diodes on the right side are deviated upward by 1200 dpi from the four light emitting diodes on the left side. As shown in FIG. 24B, the position information corresponding to the light emitting diodes is equal to (0, 0, 0, 0, 1, 1, 1, 1) in order from the left and the position information corresponding to the light emitting diodes which are deviated upward by 1200 dpi is equal to "1". It is assumed that the position information has previously been stored in the all-position information storing portion 911 and the position information storing portions 636 of the driving circuits DRV1 to DRV8.

FIG. 24C shows the print data which is sent from the image processing section 900 to the print controlling section 901. The print data is transmitted on a line unit basis from the image processing section 900 to the print controlling section 901.

FIG. 24D is the diagram showing the contents in the print data storing portion 913 after the print data of the first line was received from the image processing section 900. It is assumed here that the print data storing portion 913 can store the print data of six lines and the data of all 0 has been stored before the print data of one line is received.

When the data corresponding to LD1 of the first line is received, the order (PS1=1) of LD1 is outputted from the pointer controlling portion 912 to the all-position information storing portion 911. In response to the order (PS1=1), the all-position information storing portion 911 outputs the position information (PS2=0) of LD1. In response to (PS2=0), the pointer controlling portion 912 outputs (PS1=1) and the pointer (PS3=1) of the first line to the print data storing portion 913. In response to PS1 and PS3, the print data storing portion 913 stores the print data into the location corresponding to LD1 of the first line. In a manner similar to the above, with respect to LD2 to LD4, the order (PS1=2~4) of LD2 to LD4 and the pointer (PS3=1) of the first line are outputted to the print data storing portion 913 and the print data is stored into the locations corresponding to LD2 to LD4 of the first line, respectively.

When the data corresponding to LD5 of the first line is received, the order (PS1=5) of LD5 is outputted from the pointer controlling portion 912 to the all-position information storing portion 911. In response to the order (PS1=5), the all-position information storing portion 911 outputs the position information (PS2=1) of LD5. When the position information is (PS2=1), the pointer controlling portion 912 adds 2 to the line pointer and outputs the pointer. Therefore, the pointer controlling portion 912 outputs (PS1=5) and the pointer (PS3=3 (=1+2)) of the third line to the print data storing portion 913. In response to PS1 and PS3, the print data storing portion 913 stores the print data into the location corresponding to LD5 of the third line. In a manner similar to the above, with respect to LD6 to LD8, the order (PS1=6~8) of LD6 to LD8 and the pointer (PS3=3) of the third line are outputted to the print data storing portion 913 and the print data is stored into the locations corresponding to LD6 to LD8 of the third line, respectively.

FIG. 24E is the diagram showing the contents in the print data storing portion 913 after the print data of the second line was received from the image processing section 900. When the data corresponding to LD1 of the second line is received, the order (PS1=1) of LD1 is outputted from the pointer controlling portion 912 to the all-position information storing portion 911. In response to the order (PS1=1), the all-position information storing portion 911 outputs the position information (PS2=0) of LD1. In response to (PS2=0), the pointer controlling portion 912 outputs (PS1=1) and the pointer (PS3=2) of the second line to the print data storing portion 913. In response to PS1 and PS3, the print data storing portion 913 stores the print data into the location corresponding to LD1 of the second line. In a manner similar to the above, with respect to LD2 to LD4, the order (PS1=2~4) of LD2 to LD4 and the pointer (PS3=2) of the second line are outputted to the print data storing portion 913 and the print data is stored into the locations corresponding to LD2 to LD4 of the second line, respectively.

When the data corresponding to LD5 of the second line is received, the order (PS1=5) of LD5 is outputted from the pointer controlling portion 912 to the all-position information storing portion 911. In response to the order (PS1=5), the all-position information storing portion 911 outputs the position information (PS2=1) of LD5. When the position information is (PS2=1), the pointer controlling portion 912 adds 2 to the line pointer and outputs the pointer. Therefore, the pointer controlling portion 912 outputs (PS1=5) and the pointer (PS3=4 (=2+2)) of the fourth line to the print data storing portion 913. In response to PS1 and PS3, the print data storing portion 913 stores the print data into the location corresponding to LD5 of the fourth line. In a manner similar to the above, with respect to LD6 to LD8, the order (PS1=6·8) of LD6 to LD8 and the pointer (PS3=4) of the fourth line are outputted to the print data storing portion 913 and the print data is stored into the locations corresponding to LD6 to LD8 of the fourth line, respectively. FIG. 24F is the diagram showing the contents in the print data storing portion 913 after the print data of the fourth line was received from the image processing section 900.

Figure 25:
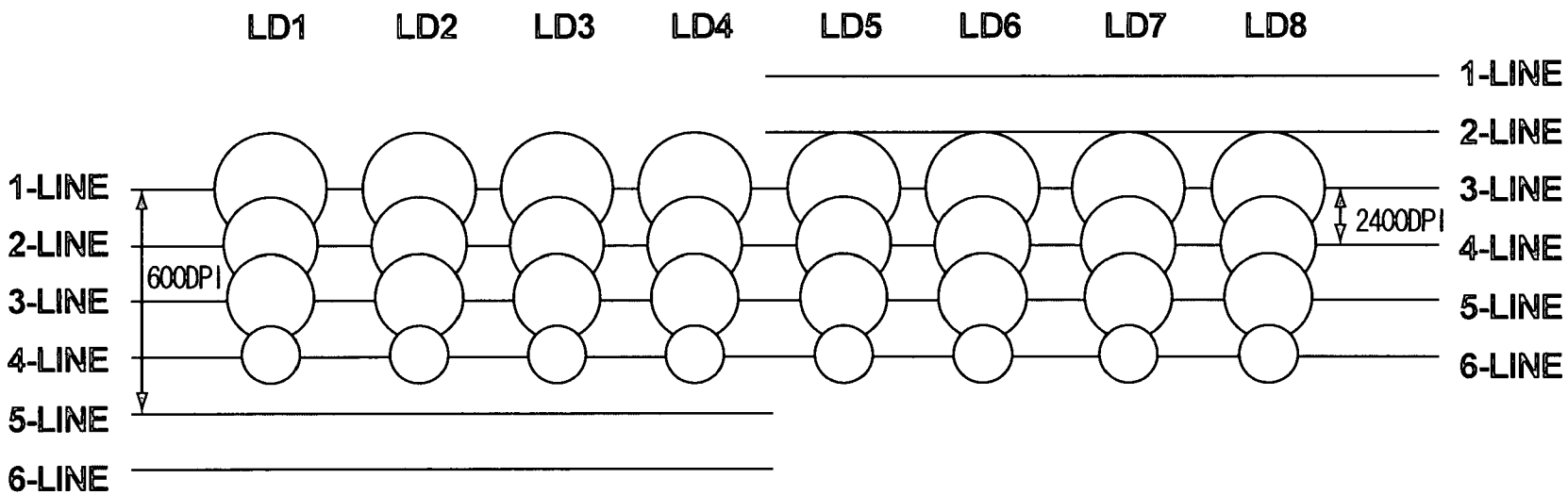
FIG. 25 is a diagram (part 3) illustrating exposure images of the light emitting diodes in the embodiment 2.

FIG. 25 is a diagram (part 3) illustrating the exposure images of the light emitting diodes in the embodiment 2.

This diagram shows the exposure images which are formed in the case where the light emission has been performed by using the LED head 600 on the basis of the print data edited as shown in FIG. 24F. In the diagram, at the first line, since the print data of LD1 to LD4 is equal to "1" and, further, the print information is equal to "0", LD1 to LD4 are driven for the time of 8P corresponding to the pulse width of the first line of the driving signal HD_STB1_N. Since the print data of LD5 to LD8 is equal to "0", LD5 to LD8 are not driven.

At the second line, since the print data of LD1 to LD4 is equal to "1" and, further, the print information is equal to "0", LD1 to LD4 are driven for the time of 4P corresponding to the pulse width of the second line of the driving signal HD_STB1_N. Since the print data of LD5 to LD8 is equal to "0", LD5 to LD8 are not driven.

At the third line, since the print data of LD1 to LD4 is equal to "1" and, further, the print information is equal to "0", LD1 to LD4 are driven for the time of 2P corresponding to the pulse width of the third line of the driving signal HD_STB1_N. Since the print data of LD5 to LD8 is equal to "1" and, further, the print information is equal to "1", LD5 to LD8 are driven for the time of 8P corresponding to the pulse width of the third line of the driving signal HD_STB2_N. At the fourth line, since the print data of LD1 to LD4 is equal to "1" and, further, the print information is equal to "0", LD1 to LD4 are driven for the time of 1P corresponding to the pulse width of the fourth line of the driving signal HD_STB1_N. Since the print data of LD5 to LD8 is equal to "1" and, further, the print information is equal to "1", LD5 to LD8 are driven for the time of 4P corresponding to the pulse width of the fourth line of the driving signal HD_STB2_N.

At the fifth line, since the print data of LD1 to LD4 is equal to "0", LD1 to LD4 are not driven. Since the print data of LD5 to LD8 is equal to "1" and, further, the print information is equal to "1", LD5 to LD8 are driven for the time of 2P corresponding to the pulse width of the fifth line of the driving signal HD_STB2_N. At the sixth line, since the print data of LD1 to LD4 is equal to "0", LD1 to LD4 are not driven. Since the print data of LD5 to LD8 is equal to "1" and, further, the print information is equal to "1", LD5 to LD8 are driven for the time of 1P corresponding to the pulse width of the sixth line of the driving signal HD_STB2_N.

As will be understood from the diagram, the deviation of the attaching positions of the light emitting diodes does not appear in the exposure result. Although the embodiment has been described above on the assumption that the LED head is used as a form of the recording head, the invention can be also applied to the recording head using the resistive device, organic EL device, or liquid crystal shutter.

Explanation of (Effects)

As described in detail above, since the apparatus has the driving circuit which has a plurality of driving signal inputs and the position information storing portion for storing the position information, selects the strobe signal on the basis of the position information, and drives the LEDs, such an effect that in the case of expressing the gradation by using n lines of different driving times, the correction can be made so that the positional deviation of the light emitting diodes does not appear in the exposure result is obtained.

Although the printer has been described as an example of the image forming apparatus according to the invention, the invention is not limited to such an example. That is, a similar effect can be also obtained if the invention is applied to other image forming apparatuses such as multifunction printer, copying apparatus, facsimile apparatus, and the like.

It should be understood by those skilled in the art that various modifications, combinations, sub-combinations and alterations may occur depending on design requirements and other factors insofar as they are within the scope of the appended claims or the equivalents thereof.

What is claimed is:

1. A recording head having a recording element array in which a plurality of recording elements are arranged, comprising:

a data signal input section to which a data signal is input;

a first driving signal input section to which a first driving signal for defining a first driving time is input;

a second driving signal input section to which a second driving signal for defining a second driving time is input, the second driving time being different from the first driving time;

a selecting section which selects one of the first driving signal and the second driving signal based on a predetermined selecting signal;

an outputting section which outputs an output signal for driving the recording element based on the data signal and said one of the first driving signal and the second driving signal selected by the selecting section;

a driving element which drives a corresponding recording element based on the output signal output by said outputting section; and a print data signal input section to which a print data signal is input, the print data signal consisting of 2 bits, an upper bit of the print data signal corresponding to the predetermined selecting signal, and a lower bit of the print data signal corresponding to the data signal.

2. The recording head according to claim 1, wherein the first driving time is longer than the second driving time.

3. The recording head according to claim 2, wherein the first driving time and the second driving time change periodically in the same period.

4. An LED head having a LED element array in which a plurality of LED elements are arranged, comprising:

a data signal input section to which a data signal is input;

a first driving signal input section to which a first driving signal for defining a first driving time is input;

a second driving signal input section to which a second driving signal for defining a second driving time is input, the second driving time being different from the first driving time;

a selecting section which selects one of the first driving signal and the second driving signal based on a predetermined selecting signal;

an outputting section which outputs an output signal for driving the LED element based on the data signal and said one of the first driving signal and the second driving signal selected by the selecting section;

a driving element which drives a corresponding LED element based on the output signal output by said outputting section; and a print data signal input section to which a print data signal is input, the print data signal consisting of 2 bits, an upper bit of the print data signal corresponding to the predetermined selecting signal, and a lower bit of the print data signal corresponding to the data signal.

5. The LED head according to claim 4, wherein the first driving time is longer than the second driving time.

6. The LED head according to claim 5, wherein the first driving time and the second driving time change periodically in the same period.

7. An image forming apparatus having a recording head including a recording element array in which a plurality of recording elements are arranged, wherein said recording head comprises:

a data signal input section to which a data signal is input;

a first driving signal input section to which a first driving signal for defining a first driving time is input;

a second driving signal input section to which a second driving signal for defining a second driving time is input, the second driving time being different from the first driving time;

a selecting section which selects one of the first driving signal and the second driving signal based on a predetermined selecting signal;

an outputting section which outputs an output signal for driving the recording element based on the data signal and said one of the first driving signal and the second driving signal selected by the selecting section;

a driving element which drives a corresponding recording element based on the output signal output by said outputting section; and a print data signal input section to which a print data signal is input, the print data signal consisting of 2 bits, an upper bit of the print data signal corresponding to the predetermined selecting signal, and a lower bit of the print data signal corresponding to the data signal.

8. The image forming apparatus according to claim 7, wherein the first driving time is longer than the second driving time.

9. The image forming apparatus according to claim 8, wherein the first driving time and the second driving time change periodically in the same period.

* * * * *